US008060966B2

(12) United States Patent
Homsi

(10) Patent No.: US 8,060,966 B2
(45) Date of Patent: Nov. 22, 2011

(54) METHOD AND APPARATUS FOR BRIDGE CONSTRUCTION

(75) Inventor: Elie H. Homsi, Broomfield, CO (US)

(73) Assignee: Flatiron Constructors, Inc., Firestone, CO (US)

( * ) Notice: Subject to any disclaimer, the term of this patent is extended or adjusted under 35 U.S.C. 154(b) by 0 days.

(21) Appl. No.: 12/426,517

(22) Filed: Apr. 20, 2009

(65) Prior Publication Data

US 2009/0282625 A1 Nov. 19, 2009

Related U.S. Application Data

(63) Continuation of application No. 11/613,945, filed on Dec. 20, 2006, now Pat. No. 7,520,014.

(60) Provisional application No. 60/751,897, filed on Dec. 20, 2005.

(51) Int. Cl.
*E01D 21/00* (2006.01)

(52) U.S. Cl. ..... 14/77.1; 14/74.5; 52/223.8

(58) Field of Classification Search ..... 14/74.5, 14/77.1

See application file for complete search history.

(56) References Cited

U.S. PATENT DOCUMENTS

| | | | | |
|---|---|---|---|---|
| 3,385,455 | A | | 5/1968 | Dal Pont |
| 3,448,511 | A | | 6/1969 | Suter |
| 3,490,605 | A | | 1/1970 | Koss |
| 3,511,057 | A | | 5/1970 | Suter |
| 3,571,835 | A | | 3/1971 | Buechler |
| 3,902,212 | A | | 9/1975 | Muller |
| 4,282,978 | A | | 8/1981 | Zambon |
| 4,604,841 | A | * | 8/1986 | Barnoff et al. ..... 52/174 |
| 4,651,375 | A | | 3/1987 | Macchi |
| 4,799,279 | A | | 1/1989 | Muller |
| 4,964,750 | A | | 10/1990 | House et al. |
| 4,982,538 | A | | 1/1991 | Horstketter |
| 5,025,522 | A | * | 6/1991 | Eskew et al. ..... 14/73 |
| 5,131,786 | A | | 7/1992 | House et al. |
| 5,145,278 | A | | 9/1992 | Lohrmann |
| 5,173,981 | A | | 12/1992 | Hasselkvist |
| 5,218,795 | A | | 6/1993 | Horstketter |
| 5,430,903 | A | * | 7/1995 | Pence ..... 14/7 |

(Continued)

FOREIGN PATENT DOCUMENTS

KR 2006028828 * 4/2006

(Continued)

OTHER PUBLICATIONS

AASHTO LRFD Bridge Design Specification, 2004, pp. 4-27 and 4-28, 3rd Edition, American Association of State Highway and Transportation Officials.

*Primary Examiner* — Raymond W Addie
(74) *Attorney, Agent, or Firm* — Christopher J. Kulish

(57) ABSTRACT

The present invention is directed to a precast girder that is used as the outer-most lateral girder in a bridge superstructure. In one embodiment, the girder is comprised of a first flange, a second flange that is separated from the first flange, and a web that connects the first flange to the second flange so that the resulting combination of the first flange, second flange, and web generally has an I-beam cross-section. The girder further includes an edge portion that is connected to the second flange and extends away from the first and second flanges.

11 Claims, 26 Drawing Sheets

U.S. PATENT DOCUMENTS

| | | | | |
|---|---|---|---|---|
| 5,471,811 | A | 12/1995 | House et al. | |
| 5,577,284 | A * | 11/1996 | Muller | 14/73 |
| 5,755,981 | A | 5/1998 | Payne | |
| 5,947,308 | A | 9/1999 | Markelz | |
| 6,145,270 | A * | 11/2000 | Hillman | 52/834 |
| 6,721,985 | B2 | 4/2004 | McCrary | |
| 6,857,156 | B1 * | 2/2005 | Grossman | 14/73 |
| 7,104,720 | B2 * | 9/2006 | Humphries et al. | 404/6 |
| 7,159,262 | B2 | 1/2007 | Jackson | |
| 7,210,183 | B2 | 5/2007 | Kornatsky | |
| 7,373,683 | B2 * | 5/2008 | Moon | 14/74.5 |
| 7,461,427 | B2 | 12/2008 | Ronald et al. | |
| 7,475,446 | B1 * | 1/2009 | He | 14/77.1 |
| 7,524,136 | B2 * | 4/2009 | Stenger | 404/72 |
| 2003/0217420 | A1 | 11/2003 | Snead | |
| 2004/0148717 | A1 | 8/2004 | Kornatsky | |
| 2009/0241452 | A1 * | 10/2009 | Hillman et al. | 52/309.17 |

FOREIGN PATENT DOCUMENTS

| | | | |
|---|---|---|---|
| SU | 1193203 | * | 11/1985 |
| SU | 1451203 A1 | * | 1/1989 |

* cited by examiner

METHOD AND APPARATUS FOR BRIDGE CONSTRUCTION

FIELD OF THE INVENTION

The present invention is directed to an apparatus for use in constructing a bridge and a method for constructing a bridge.

BACKGROUND OF THE INVENTION

The main elements of the type of bridge to which the invention is directed are: (a) a substructure; and (b) a superstructure.

A substructure is comprised of (1) foundations and (2) piers. The foundations are the components of the substructure that engage or interact with the earth to support the bridge structure. A foundation can be constructed of one or more piles, one or more concrete drilled shafts, one or more concrete mats, and combinations thereof. Presently, piles include precast concrete piles and steel piles. The piers are the components of the substructure that transfer the bridge structural loads to the foundations. A pier can be constructed of columns, struts, pile caps, pier caps, and combinations thereof. Presently, columns include cast in place columns, precast concrete columns, and steel columns.

A superstructure carries the traffic load (vehicular, rail, and/or pedestrian) on the bridge. A superstructure can be constructed using girders that each typically span the distance between two adjacent piers. Presently, girders include precast concrete girders, cast in place girders, precast concrete box girders, segmental box girders, steel girders, and steel box girders. Some superstructures use two or more different types of girders.

Presently, there are several methods of constructing a bridge comprised of a substructure and a superstructure (hereinafter referred to as a "bridge") in situations in which there is limited access from the ground. Characteristic of each method is the use of one or more conventional cranes that are each capable of rotating a boom about horizontal and vertical axes to either move an element of bridge into place or manipulate a tool that is used in constructing the bridge. One method employs a crane that is positioned on top of and near the end of the existing superstructure to position a pile driver and a pile beyond the end of the superstructure so that the pile can be driven into the earth to form the next foundation. Typically, a second crane is used to provide piles to the pile driver associated with the first crane, construct the pier that engages the pile or piles of the foundation established by the first crane, and construct the, either alone or in combination with the first crane, the superstructure. A drawback associated with this method is that the piers must be spaced relatively close together due to the construction loads imposed upon the bridge by the crane, the pile driver, and the pile.

Another method for constructing a bridge when the bridge is being built over a watercourse or wetland involves using a temporary structure that extends outside the footprint of the resulting bridge to support cranes and the like that are used in constructing the bridge and, in particular, the substructure of the bridge. In many case, the temporary support structure adversely affects the portions of the watercourse or wetland that are outside the footprint of the bridge. Typically, the temporary support structure supports a first crane to which a pile driver has been attached, a second crane for loading a pile into the pile driver associated with the first crane, a third crane for constructing a pier on each of the foundations established by the first and second cranes, and a fourth crane for putting the girders in place between adjacent piers. In some cases, the third and/or fourth crane are replaced with a moveable gantry or truss that spans the distance between at least two adjacent piers and is located above and substantially parallel to the superstructure to construct the piers and establish girders between adjacent piers.

Also associated with the construction of bridges is the attachment of L-shaped form to the outer-most lateral girders and the subsequent pouring of concrete into the forms to establish an L-shaped concrete member along the lateral edges of the superstructure. These L-shaped members typically facilitate the establishment of barriers along the lateral edges of the superstructure and serve to contain the concrete or other fluid material that is used to establish the superstructure deck.

SUMMARY OF THE INVENTION

The present invention is directed to an apparatus and method for use in constructing a bridge that substantially avoids the need for a temporary support structure for cranes and other machinery and/or the need to use conventional cranes to manipulate the main elements of the substructure and superstructure that are used to form the bridge.

In one embodiment, the apparatus is comprised of: (a) a truss structure that extends from a first end to a second end, (b) a support structure that, in operation, supports the truss structure such that a portion of the truss structure is above and substantially parallel to the superstructure or planned location of a portion of the superstructure, (c) a trolley that, in operation, is supported by the truss structure, capable of hoisting an object associated with the building the bridge, and movable between the ends of the truss structure, (d) a lead assembly that, in operation, is operatively attached to the truss structure and comprises a lead, a pivot joint for pivotally connecting the lead to the truss structure, and an actuating system for causing the lead to pivot to a desired rotation position. When the lead is in a predefined position, the lead is capable of receiving an object from the trolley. For example, the lead can receive a pile from the trolley and rotate the pile to place the pile in the desired rotational orientation for establishing a pier.

Another embodiment of the apparatus comprises a lead assembly that comprises a lead, a pivot joint for pivotally connecting the lead to the truss structure, an actuator system for causing the lead to pivot to a desired rotational position, and a tool that is operatively attached to the lead. In one embodiment, the tool is a hammer that is used to drive a pile that is held by the lead into the ground. In another embodiment, the tool is a drill that is used in drilling a hole for accepting a portion of a pile or in drilling a hole for a concrete drilled shaft, i.e., a concrete pile that is formed by excavating a hole within a casing that has been hammered or otherwise driven into the ground, filling the hole with concrete, and subsequently removing the casing. Yet a further embodiment comprises a conveyor system that is used to remove the earth that the drill excavates from a hole that is being established in the ground.

Yet a further embodiment of the apparatus comprises a lead, a two-axis pivot joint for connect the lead to the truss structure and allowing the lead to be rotated about a first axis and a second axis, an actuator system for causing the lead to rotate about the first and second axes to desired rotational positions relative to the first and second axes. The ability to rotate the lead about two axes allows foundations that have battered piles (i.e., piles that are oriented other than plumb) to be constructed, as well as foundations that have plumb piles, and to compensate for various misalignments or variations in the orientation of the truss structure.

One embodiment of the method of constructing a bridge comprises providing a bridge building apparatus that comprises (a) a truss structure that extends from a first end to a second end, (b) a trolley that is operatively attached to the truss structure, capable of hoisting an object, and movable between the first and second ends of the truss structure, (c) a lead that is operatively attached to the truss structure and capable of being rotated between a first position at which the lead is capable of receiving an object from the trolley and a second position. The method further comprises positioning the bridge building apparatus so that a portion of the truss structure is above and substantially parallel to a portion of the superstructure or planned location of a portion of the superstructure. The method further comprises placing the lead in the first position, using the trolley to move a substructure related element so that the substructure related element is received by the lead, and rotating the lead so that lead and the substructure related element to an orientation suitable for positioning the substructure related element to aid in the construction of the bridge.

In an embodiment of the method in which the substructure related element is a pile, the method further comprises lowering the pile until the pile engages the ground and then hammering the pile into the ground. Similarly, in an embodiment in which the substructure related element is a casing for use in casting a concrete shaft, the method further comprises lowering the casing until the casing engages the ground and then hammering the casing into the ground.

An embodiment of the method in which the substructure related element is a pier column further comprises lowering the pier column until the pier column engages a pre-established foundation or pier structure. Similarly, an embodiment of the method in which the substructure related element is column form or casing for use in casting a pier column, the method further comprises lower the casing until the form or casing engages a pre-established foundation or pier structure.

Yet another embodiment of the method comprises using the trolley to position a girder between two adjacent piers.

A further embodiment of the method comprises: (a) providing a bridge building apparatus that include a truss structure, trolley, and lead that can be rotated to a position at which the lead can receive a substructure related element, (b) positioning the truss structure above and substantially parallel to a portion of the superstructure or a planned location for a portion of the superstructure, (c) positioning, if needed, the truss structure so that the lead can be used to put in place a substructure element, (d) using the trolley and the lead to position a substructure element, (e) positioning, if needed, the truss structure so that the trolley can be used without the lead to position a substructure element or a superstructure element, (f) using the trolley to position a substructure element or superstructure element.

The present invention is also directed to a pre-cast edge girder, i.e. a girder that is used is the outer-most lateral girder in a bridge. The pre-cast edge girder is comprised of a laterally extending portion and an vertical extending portion that is operatively connected to the laterally extending portion thereby forming an L-shaped edge girder. Since the L-shaped edge girder is pre-cast, the need to use forms to establish an L-shaped concrete member along the lateral edges of the superstructure is avoided.

DETAILED DESCRIPTION

The present invention is directed to an apparatus for use in bridge construction that is comprised of: (a) a truss structure, (b) a support structure for supporting the truss structure such that a portion of the truss structure is above and substantially parallel to a portion or planned portion of a superstructure of a bridge, (c) a trolley structure that is supported by the truss structure and used to move materials used to build the bridge, and (d) a lead assembly that is operatively attached to the truss structure and comprised of a rotatable lead that is capable of receiving a object from the trolley that is useful in constructing the bridge.

Figure 1:
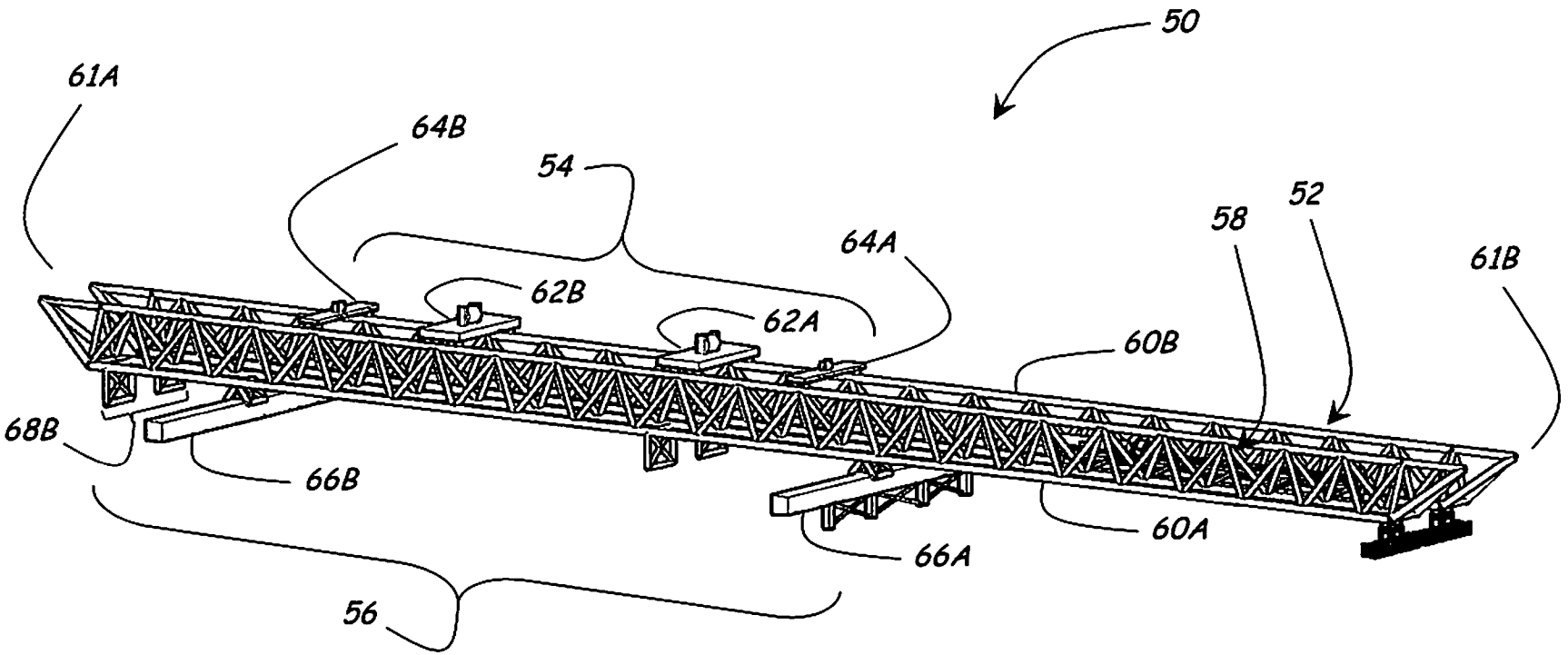
FIG. 1 illustrates the components of an embodiment of an apparatus that is useful in assembling a bridge.

FIG. 1 illustrates an embodiment of the bridge construction apparatus, hereinafter referred to as apparatus 50. The apparatus 50 is comprised of: (a) a truss structure 52; (b) trolley structure 54; (c) a support structure 56; and (d) a lead assembly 58.

The truss structure 52 is comprised of a first truss 60A and a second truss 60B that is situated substantially parallel to the first truss 60A. The truss structure 52 extends from a first terminal end 61A to a second terminal end 61B. It should be appreciated that other truss structures are feasible. For example, a truss structure that is comprised of a single truss or a truss structure that is comprised of more than two trusses is feasible and may be desirable in certain situations. Further, in contrast to straight character of the truss structure 52, a truss structure that is curved is feasible and may be desirable if a bridge design follows a curve rather than a straight line. Additionally, a truss structure that is capable of being modified or articulated so that the truss follows a path that comprised of combinations of straight segments, combinations of curved segments, and combinations of straight and curved segments is also feasible.

The trolley structure 54 is comprised of four elements: a first main trolley 62A, a second main trolley 62B, a first auxiliary winch 64A, and a second auxiliary winch 64B. As illustrated, the first and second main trolleys 62A, 62B, and first and second auxiliary winches 64A, 64B, are capable of operating as a single unit, as separate units, and as intermediate combinations. The ability to operate the elements of the trolley system 64A as separate elements or as one or more combinations of two or more elements facilitates many of the bridge building operations of the apparatus 50. Nonetheless, it should be appreciated that a trolley system with a different number of elements is feasible. For instance, a trolley system comprised of a single trolley is feasible.

The support structure 56 is comprised of a center support 66A, rear support 66B, center auxiliary support 68A, and rear auxiliary support 68B. After the initial positioning of the supports at the commencement of the bridge construction, the center and rear supports 66A, 66B, and the center and rear auxiliary supports 68A, 68B, must be moved from one location to another location to facilitate the forward movement of the truss structure 52 to a new location. At least the center support 66A and rear support 66B are moved from one location to another using the trolley system 54. Typically, the center and rear auxiliary supports 68A, 6B are also moved using the trolley system 54. The center support 66A and/or the rear support 66B incorporate motors and related structures that engage the truss structure 52 to move the truss structure 52 relative to the center support 66A and rear support structure 66B as is known to those in the art that have employed such trusses to position girders. It should be appreciated, however, that the incorporation of motors into the center and rear supports 66A, 66B is not necessary and that movement of the truss structure can be accomplished by other devices, including winches. It should be appreciated that other support systems that are capable of supporting the truss structure such that a portion of the truss structure 52 is above and substantially parallel to a portion or planned portion of the superstructure are feasible. For example, a support system that comprises a motorized, tracked or wheeled, rear support can be fixedly attached to the rear of the truss structure and thereby eliminate the need for the rear auxiliary support. Other support structures could incorporate more supports than the four elements of the support structure 56.

Figure 2:
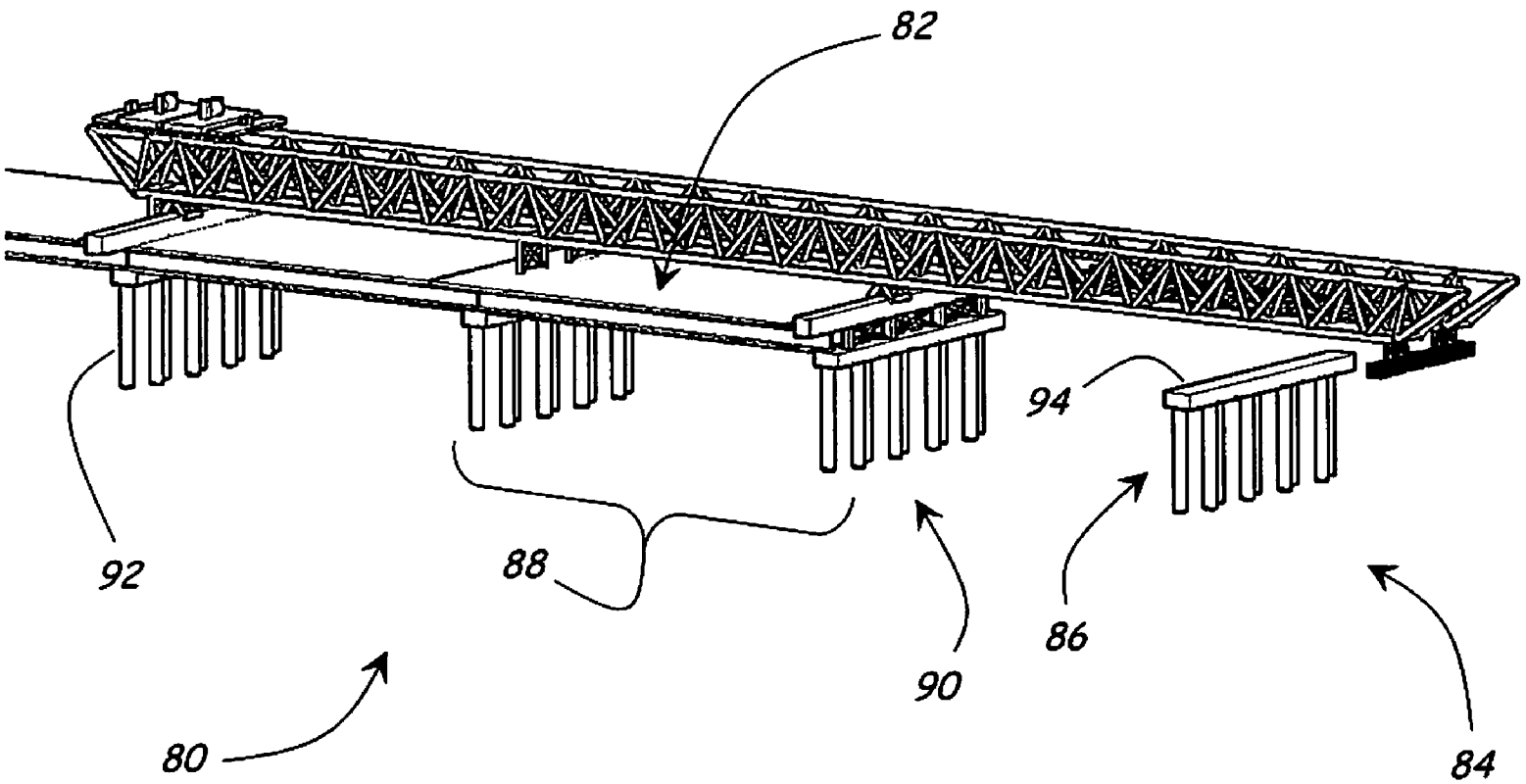
FIG. 2 illustrates a first position of the apparatus shown in FIG. 1 in which the apparatus has been used to establish girders and deck between a first pair of pier structures and a lead pier structure.

FIG. 2 illustrates the apparatus 50 in a first position with respect to a bridge 80 that is under construction. The bridge 80 is comprised of a superstructure 82 and a substructure 84 that supports the superstructure 82. The substructure 84 is comprised of foundations that are each comprised of a series of piles and piers that are each comprised of a pier cap that engages the piles of a foundation. The superstructure is comprised of steel girders that are of sufficient length to extend between and engage adjacent pier caps. It should be appreciated that the bridge 80 is exemplary of the type of bridge that the apparatus 50 is capable of being used to construct and that the apparatus is capable of being used to construct bridges with: (a) foundations that are each comprised of a concrete precast pile(s), a concrete drilled shaft(s), a steel structural member(s) or pile(s), a concrete mat(s), any other main foundation element known in the art, and combinations thereof, (b) piers that are each comprised of cast in place column(s), a precast concrete column(s), a steel column(s), a strut(s), a pile cap(s) (precast or cast in place), a pier cap(s) (precast or cast in place), a bent cap(s), any other main pier element known in the art, and combinations thereof, and (c) superstructures comprised of precast girders, cast in place box girders, precast box girders, segmental box girders, hollow slabs, steel girders, steel box girder, any other main superstructure elements known in the art, and combinations thereof.

With continuing reference to FIG. 2, for the purpose of describing the method in which the apparatus is used to construct a bridge, the substructure 84 is comprised of a last or latest pier structure 86 and a first pair of pier structures 88. The first pair of pier structures 88 is comprised of a penultimate pier structure 90, i.e., the pier structure that is next to the last pier structure 86. Each of the pier structures is comprised of a plurality of piles 92 and a pier or pile cap 94.

Figure 3:
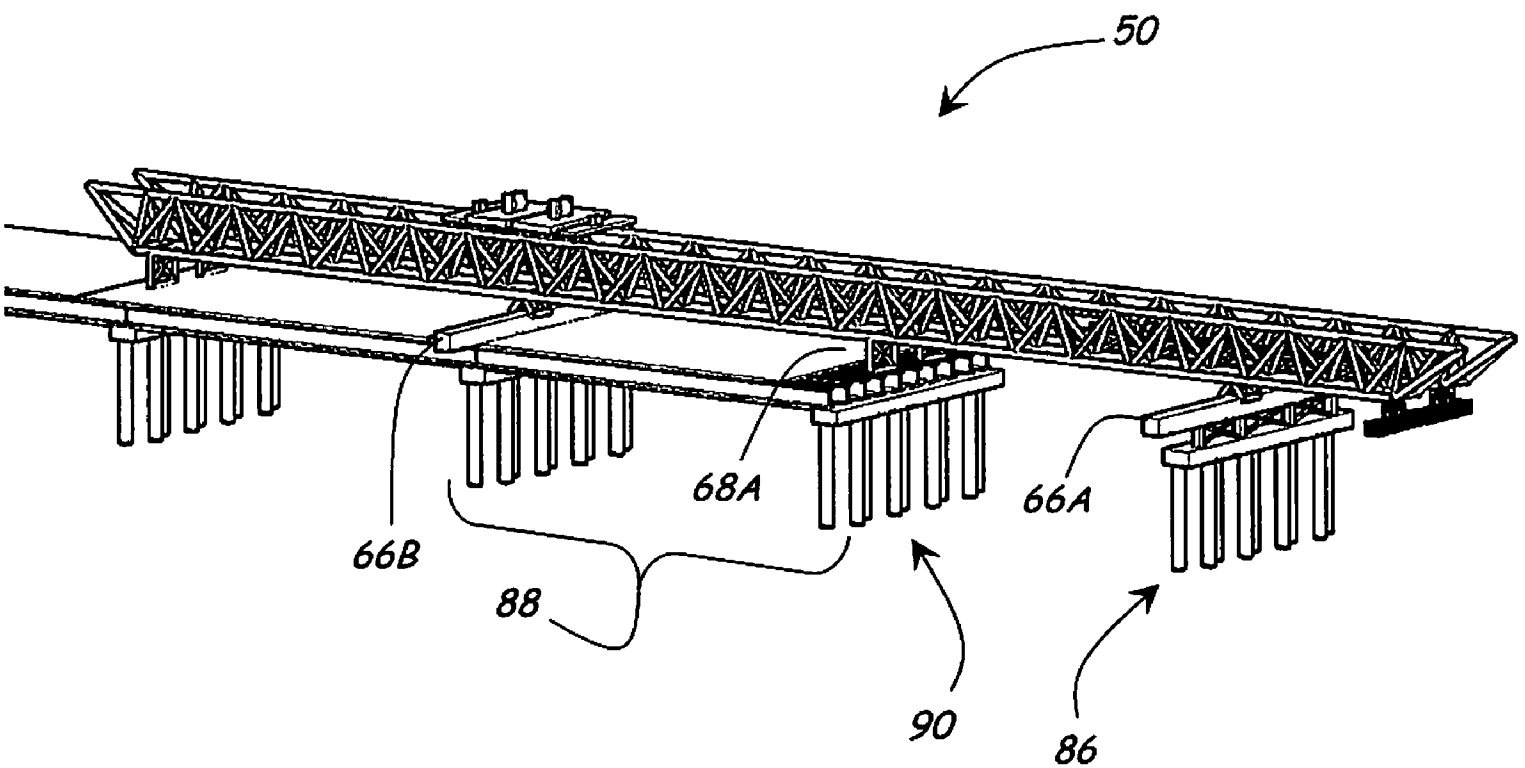
FIG. 3 illustrates the repositioning of the supports of the apparatus shown in FIG. 1 so that the truss can be repositioned and then used to erect girders between the lead pier structure and the penultimate pier structure and to establish a new lead pier structure.

FIG. 3 illustrates the positions to which the center support 66A, rear support 66B, and the center auxiliary support 68A are moved with the trolley structure 54 to enable the truss structure to be repositioned 52 so that girders can be erected between the lead pier structure 86 and the penultimate pier structure 90 and a new lead pier can be established. Specifically, the center auxiliary supports 68A have been moved forward to a location just behind the penultimate pier structure 90. Subsequently, the center support 66A has been moved from the penultimate pier structure 90 to the lead pier structure 86. Subsequently, the rear support 66B has been moved forward to a location substantially adjacent to the pier that precedes the penultimate pier structure 90.

Figure 4:
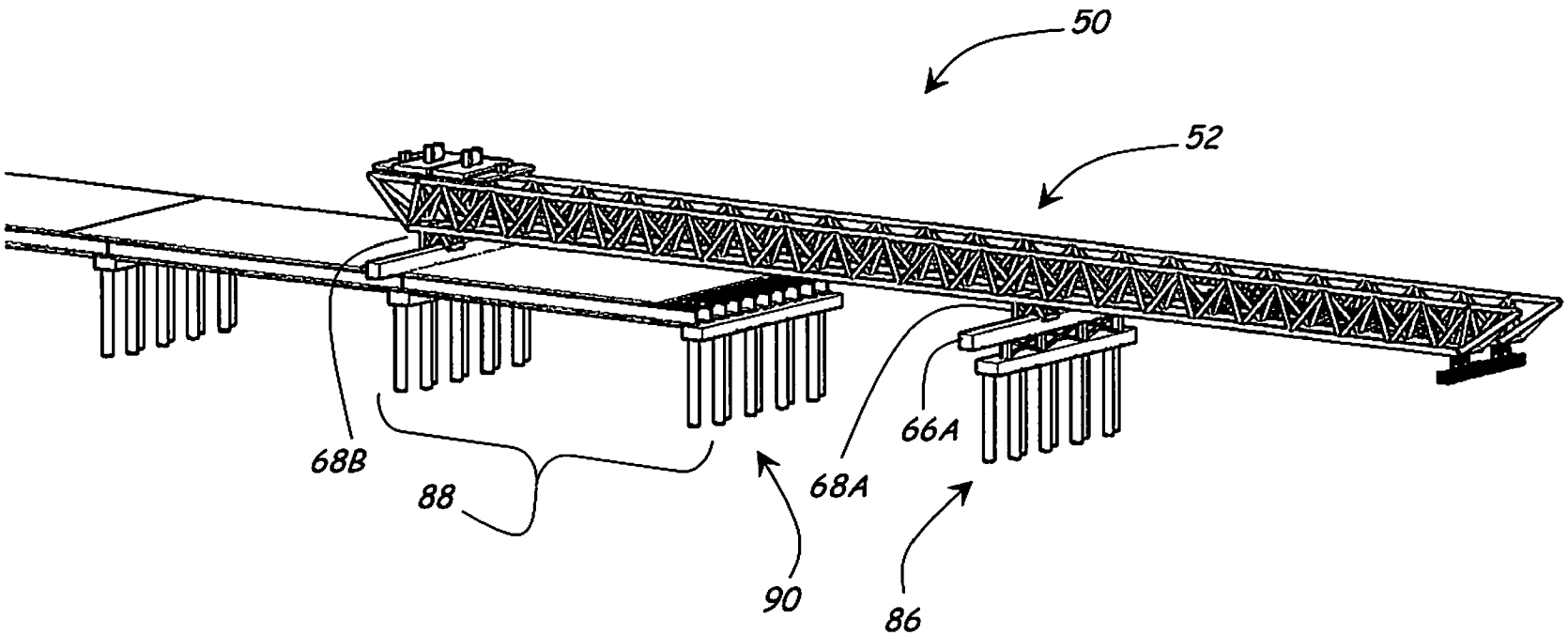
FIG. 4 illustrates the repositioning of the truss of the apparatus shown in FIG. 1 so that girders can be erected between the lead pier structure and the penultimate pier structure and a new lead pier structure can be established.

FIG. 4 illustrates the repositioning of the truss structure 52 so that girders can be established between the lead pier structure 86 and the penultimate pier structure 90 and a new lead pier can be established. The truss structure 52 is moved using motor assemblies (not shown) that are associated with the center support 66A, rear support 66B, trolley structure 54, and/or an external force applying structure. Movement of the truss structure 52 also repositions the center auxiliary supports 68A immediately behind the center support 66A and the rear auxiliary supports 68B immediately behind the rear support 66B.

Figure 5:
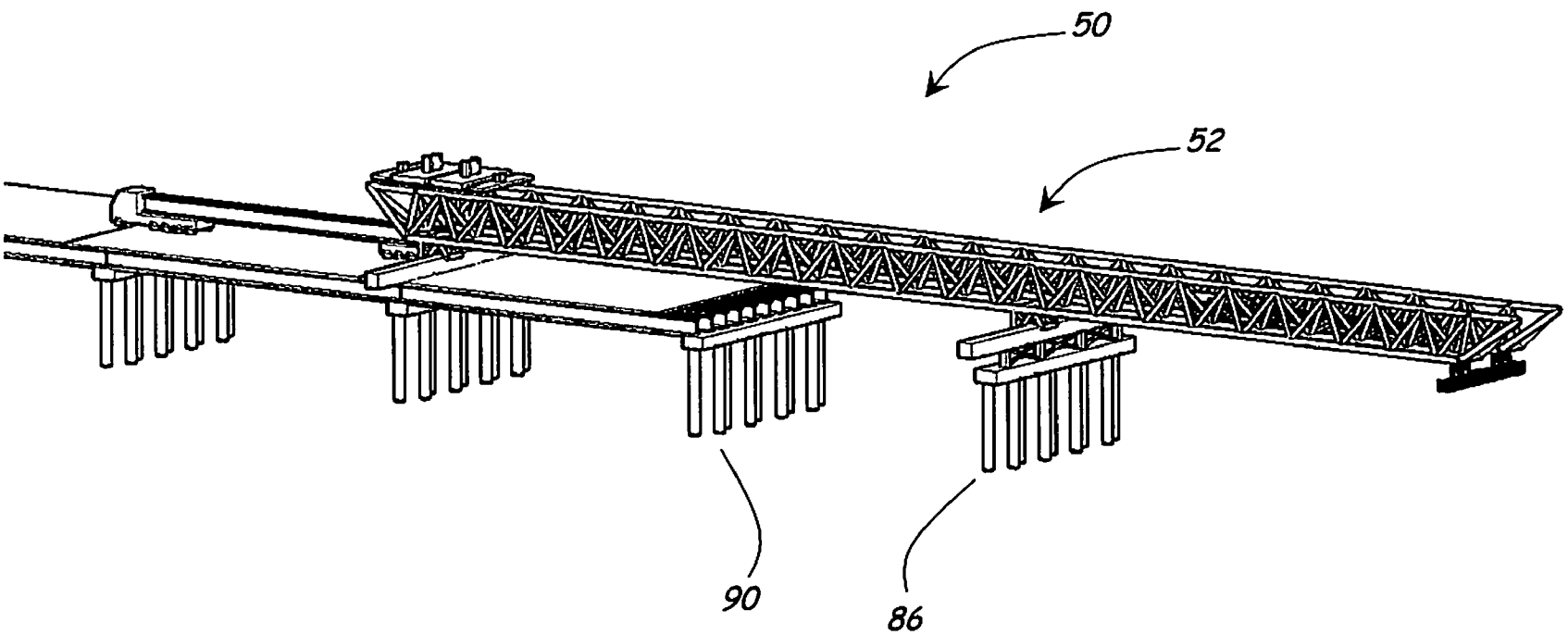
FIG. 5 illustrates the delivery of a girder that is to be placed between the lead pier structure and the penultimate pier structure.

FIG. 5 illustrates the delivery of a girder 100 that is to be erected between lead pier structure 86 and the penultimate pier structure 90.

Figure 6:
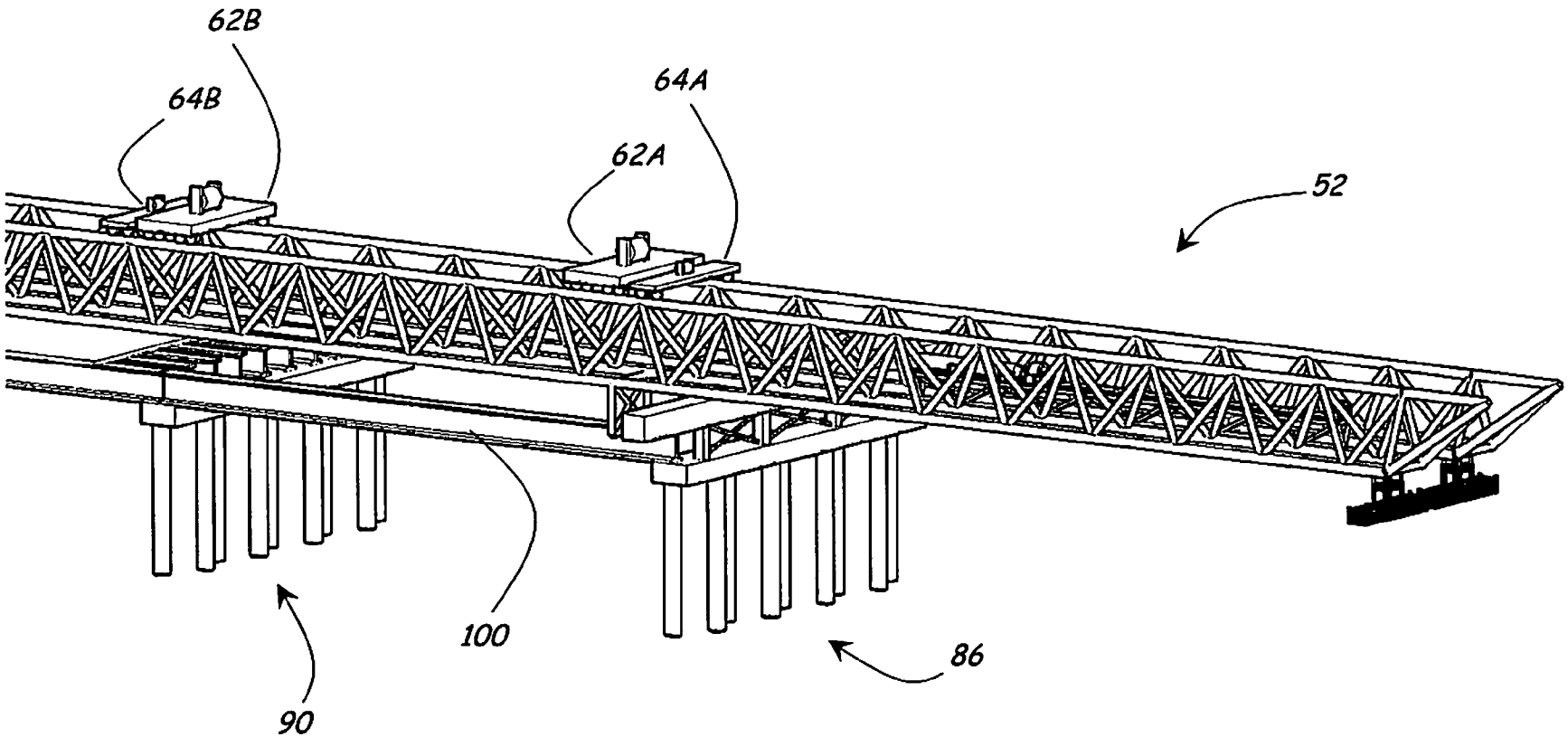
FIG. 6 illustrates the use of the trolley to erect the girder shown in FIG. 5 between the lead pier structure and the penultimate pier structure.

FIG. 6 illustrates the use of the first and second main trolleys 62A, 62B in lowering the girder 100 into place between the lead pier structure 86 and the penultimate pier structure 90. As should be appreciated, the apparatus 50 is used to position the girder 100 but the establishment of a welded, bolted, or other suitable connection between the girder 100 is not done by the apparatus 50 but by other means. This is also the case with other elements of the bridge.

Figure 7:
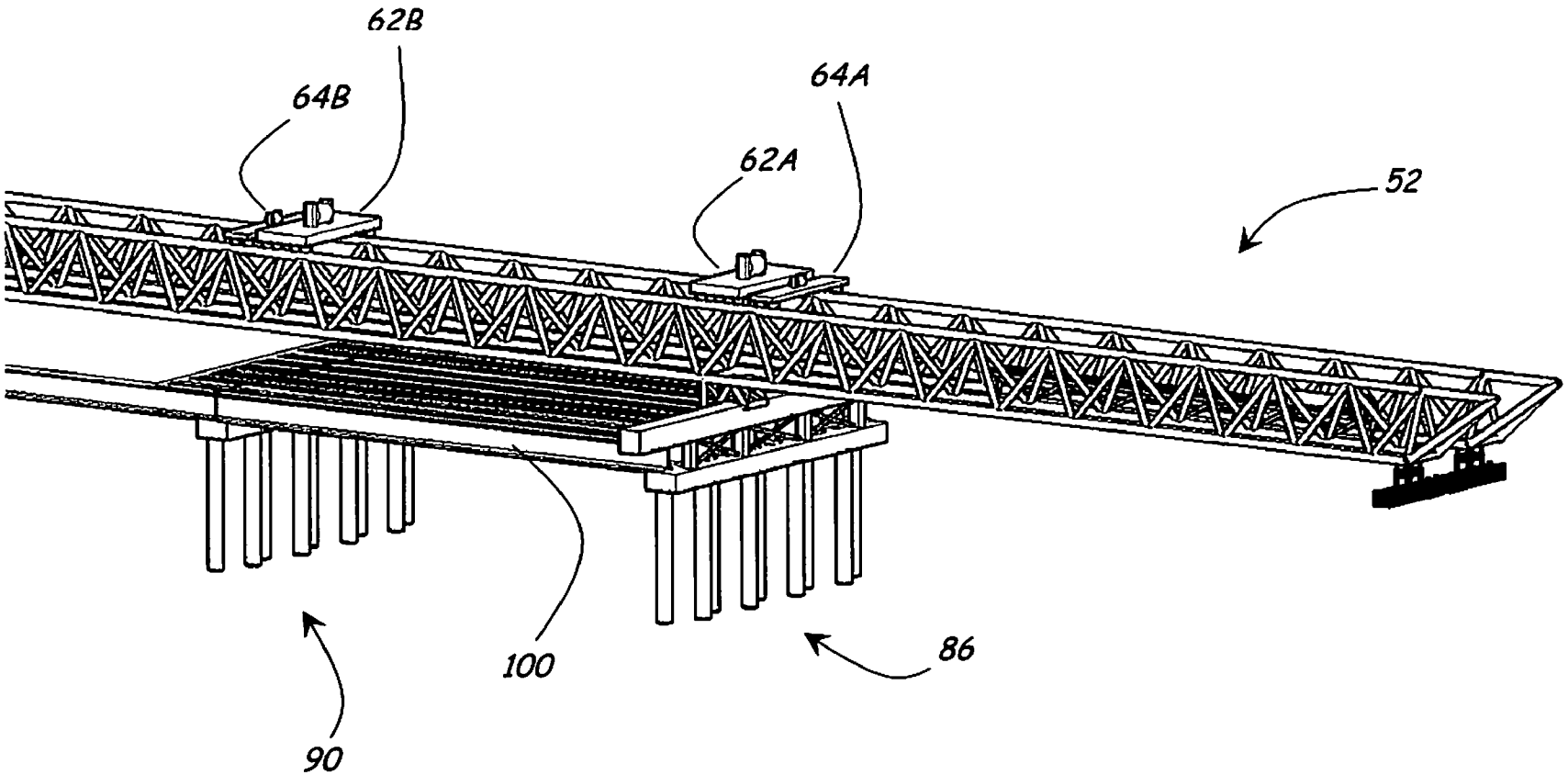
FIG. 7 illustrates a complete set of girders extending between the lead pier structure and the penultimate pier structure.

FIG. 7 illustrates the use of the first and second main trolleys 62A, 62B in lowering a final girder of a plurality of girders that extend between the lead pier structure 86 and the penultimate pier structure 90 into place. It should be appreciated that in establishing the plurality of girders between the lead pier structure 86 and the penultimate pier structure 90, the truss structure 52 moves laterally. The lateral movement is accomplished by motor assemblies associated with the center support 66A and the rear support 66B as is known in the art.

Figure 8:
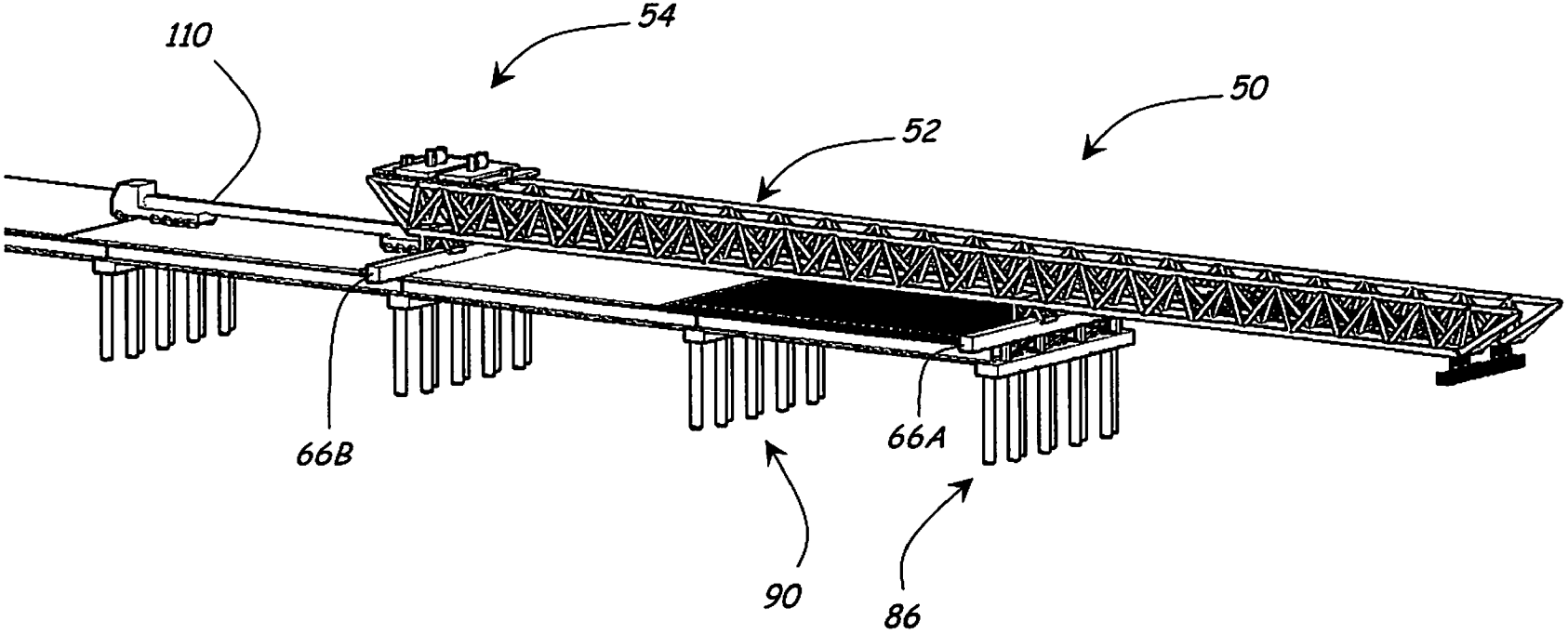
FIG. 8 illustrates the delivery of a pile for the new lead pier structure.

FIG. 8 illustrates the delivery of a pile 110 that will be part of a new lead pier structure that the apparatus 50 will be used to establish at a location beyond the current lead pier structure 86.

Figure 9:
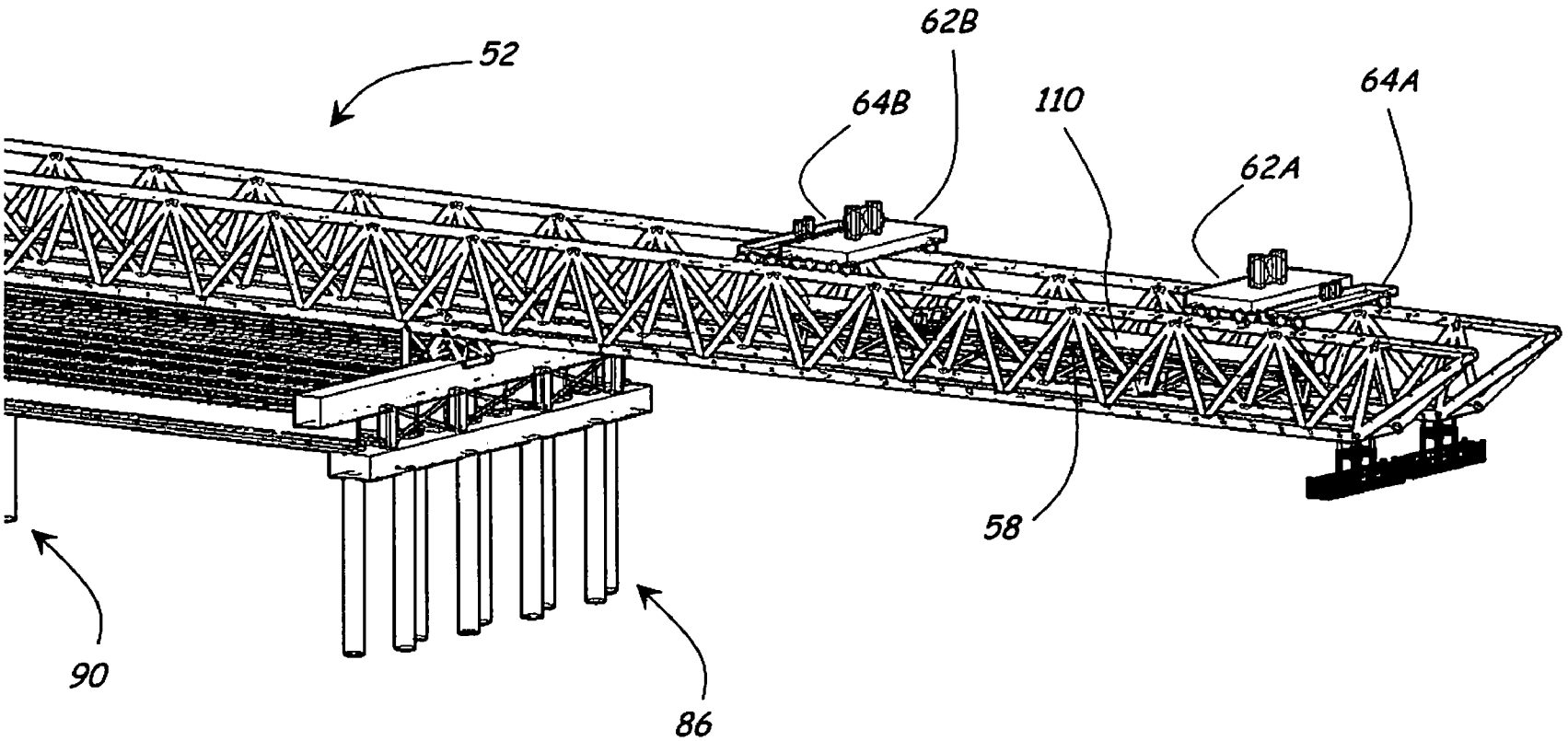
FIG. 9 illustrates the use of the trolley to lower the pile shown in FIG. 8 onto the pile driver lead and hammer assembly.

FIG. 9 illustrates the use of the trolley structure 54 to lower the pile 110 onto the lead assembly 58, which in the illustrated embodiment comprises a hammer for use in driving the pile into the ground, a guide system for holding the pile in the lead and guiding the pile during the hammering of the pile into the ground, and a winch for lowering the hammer and the pile 110 until the pile engages the ground and thereafter lowering the hammer as the pile is driven into the ground. The pile 110 is received by a guide and engaged by a collar clamp that prevents the pile 110 from slipping during rotation of the pile into position for driving into the earth. Further, the pile 110 is positioned so that an end of the pile is located adjacent to the hammer that is used to drive the pile into the earth.

Figure 10:
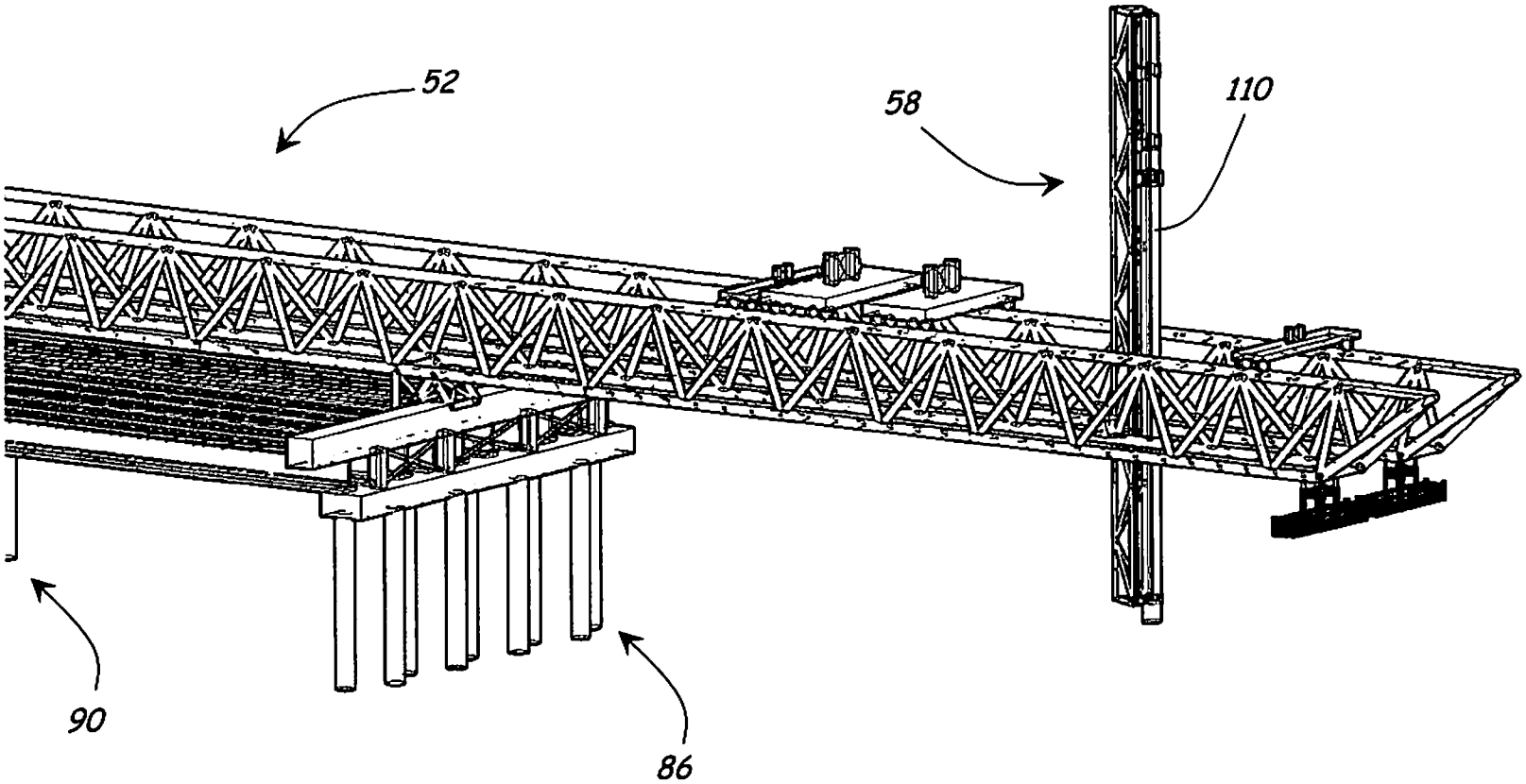
FIG. 10 illustrates the rotation of the pile driver lead and hammer assembly and the pile held by the assembly.

FIG. 10 illustrates the use of the lead assembly 58 to rotate the pile 110 into a position that is suitable for driving the pile 110 into the earth.

Figure 11:
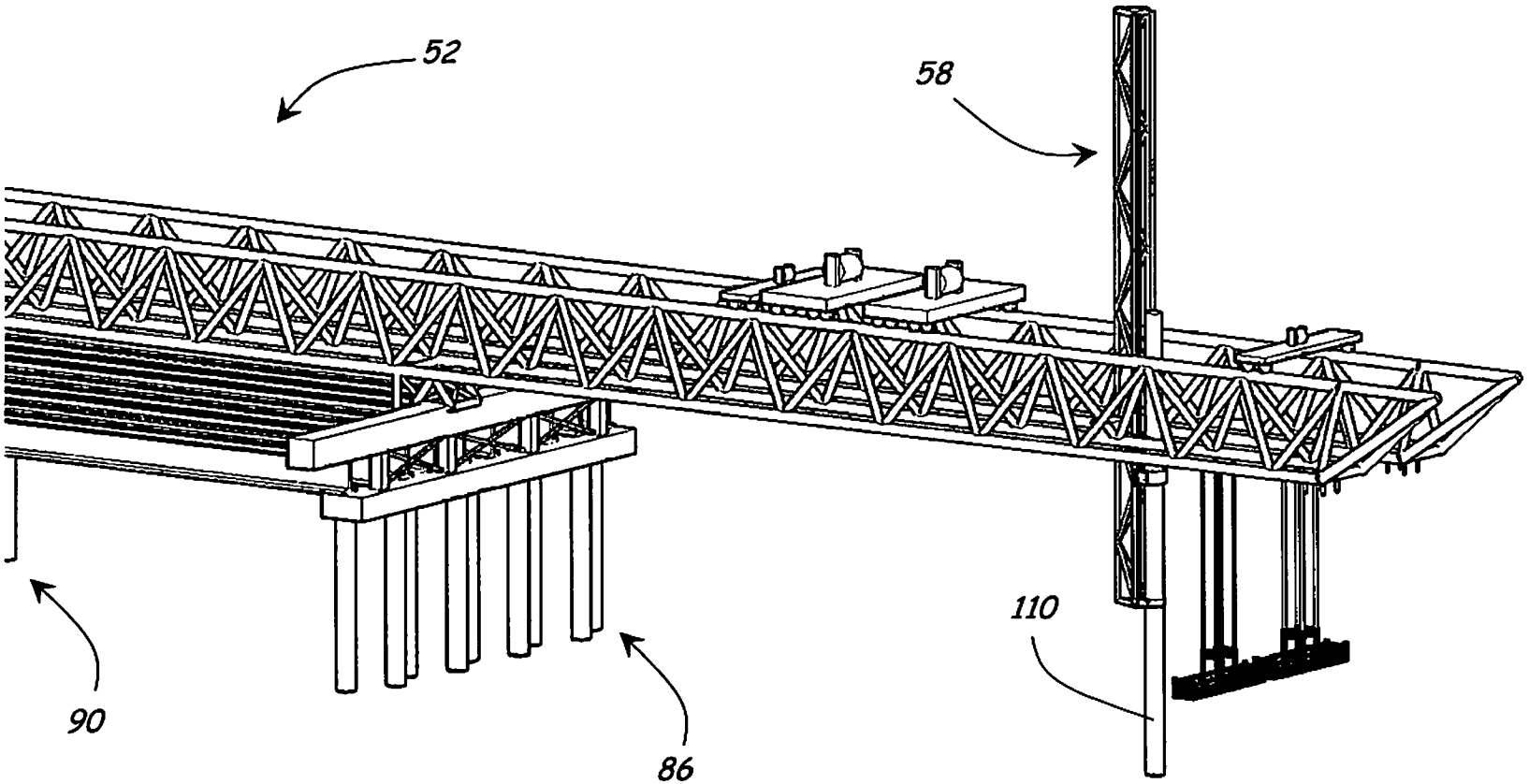
FIG. 11 illustrates the use of the pile driver lead and hammer assembly to lower the pile so that the distal end of the pile engages the earth into which the pile is to be driven.

FIG. 11 illustrates the use of the lead assembly 58 to lower the pile 110 to the point at which the distal end of the pile 110 engages the earth and can be driven into the earth using the hammer associated with the lead assembly 58.

Figure 12:
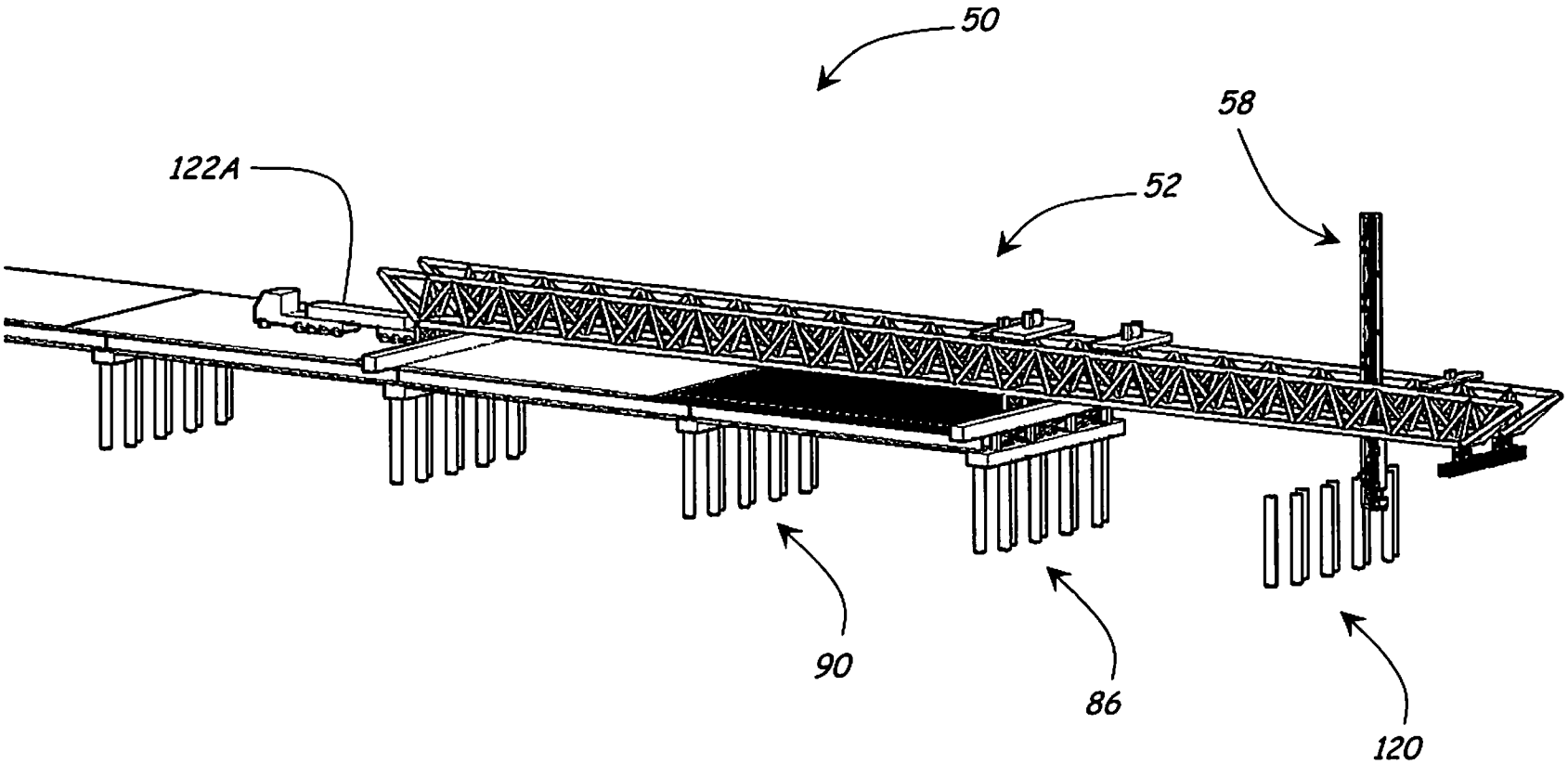
FIG. 12 illustrates the establishment of several piles in the new lead pier structure.

FIG. 12 illustrates the apparatus 50 after the lead assembly 58 has been used to drive several piles that are associated with a yet to be completed, new lead pier 120 into the earth and the delivery of a first pier cap form or pre-cast shell 122A that will be placed on top of a number of the piles of the new lead pier 120.

Figure 13:
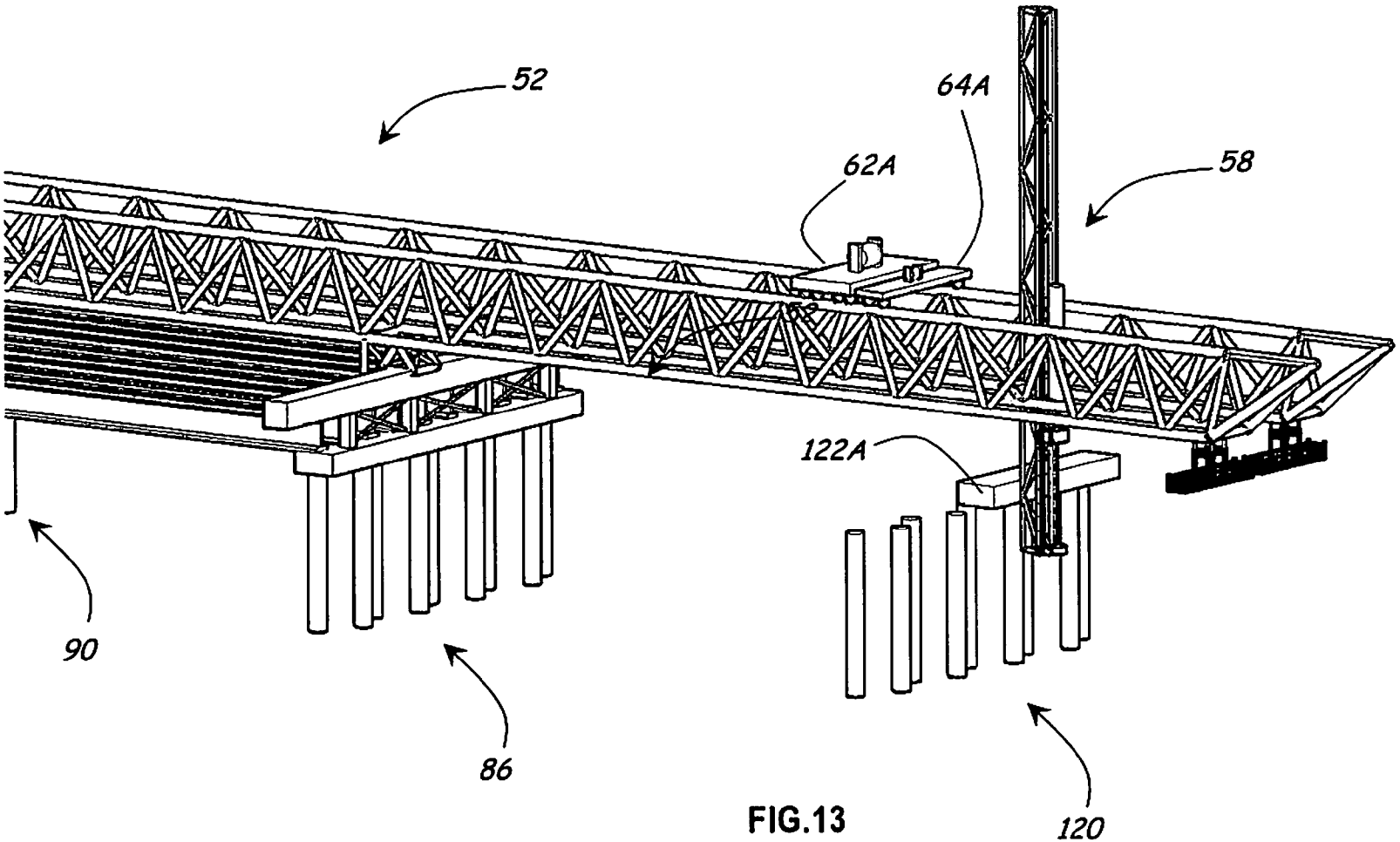
FIG. 13 illustrates the use of the trolley to establish a first half of a pier cap form or pre-cast shell on top of several of the piles of the new lead pier structure.

FIG. 13 illustrates the use of the first main trolley 62A to lower the first pier cap form or pre-cast shell 122A onto several of the piles of the new lead pier structure 120. Prior to the lowering of the first pier cap form or pre-cast shell 122A onto the piles, the hammer associated with the lead assembly 58 was removed from the lead assembly 58. The removal of the hammer reduces the force that is applied to the truss structure 54 during the establishment of the pier cap of the new lead pier structure 120. In appropriate circumstances, removal of the hammer may not be necessary. In addition, prior to the lowering of the first pier cap form or pre-cast shell 122A onto the piles, the lead portion of the lead assembly 58 was rotated into the illustrated upright position so as not to interfere with the lowering of the first pier cap form or pre-cast shell 122A onto the piles.

Figure 14:
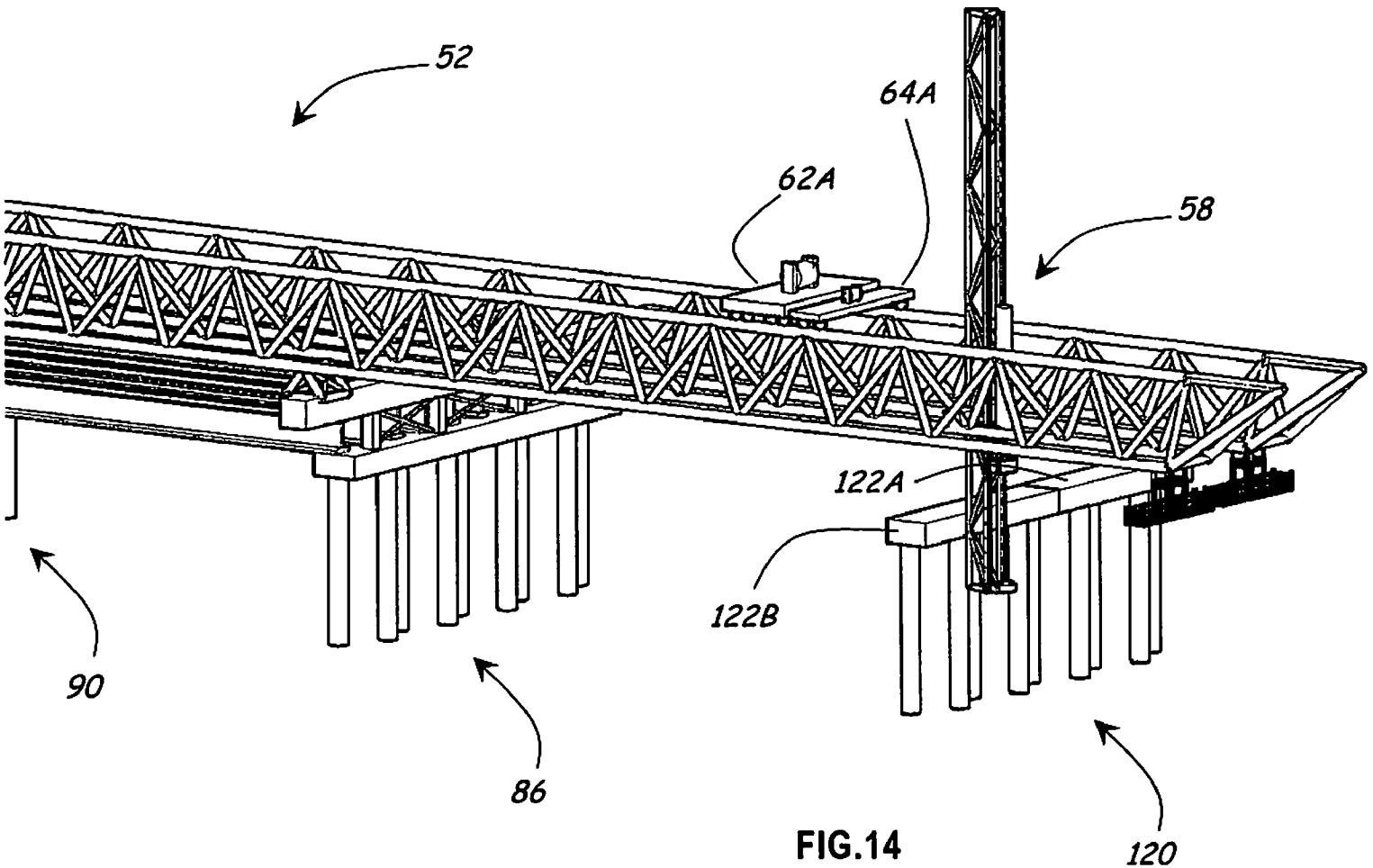
FIG. 14 illustrates the use of the trolley to establish a second half of a pier cap form or pre-cast shell on top of several of the piles of the new lead pier structure.

FIG. 14 illustrates the use of the first main trolley 62A to lower the second pier cap form or pre-cast shell 122B onto a number of the piles associated with the new lead pier structure 120.

Figure 15:
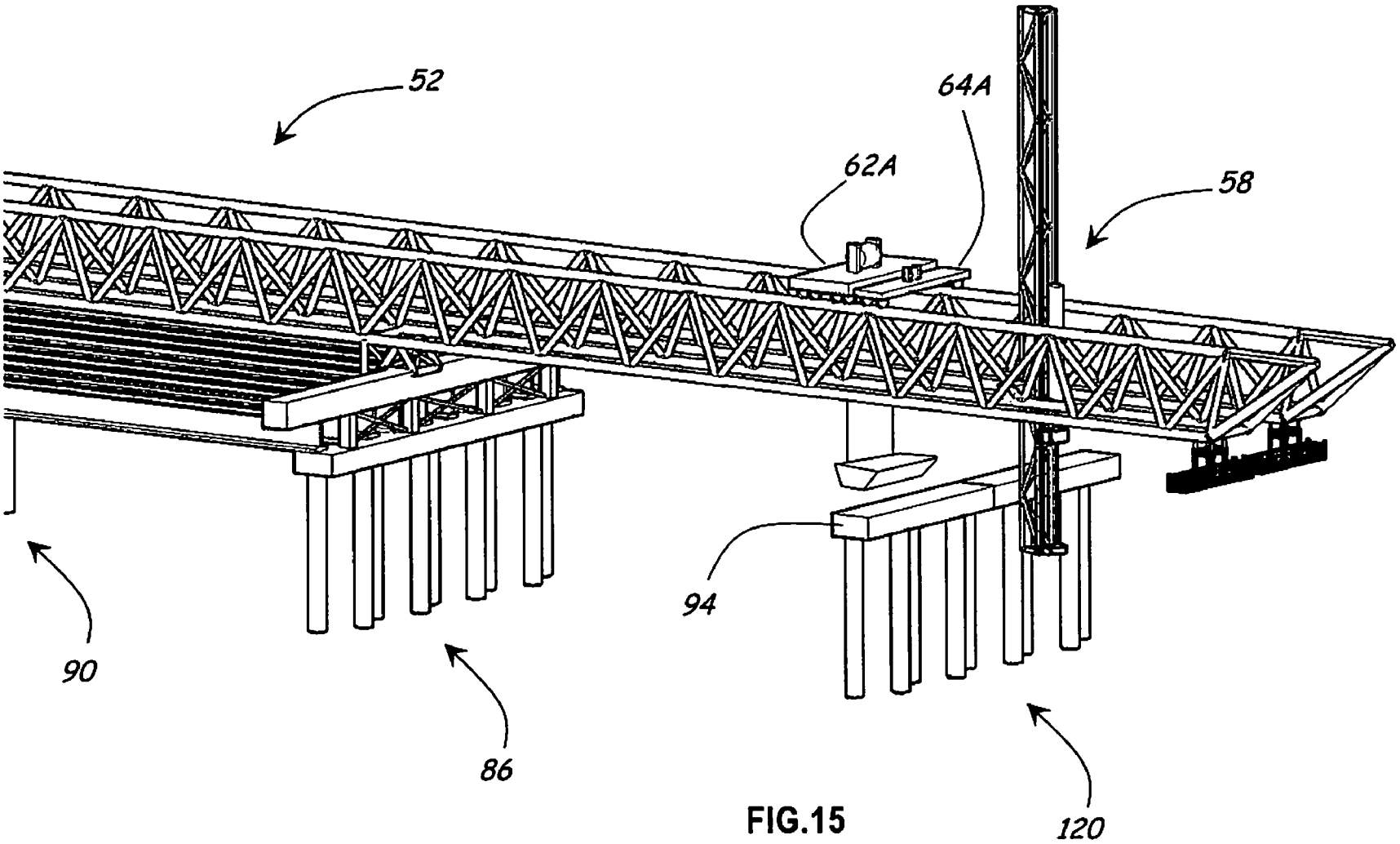
FIG. 15 illustrates the use of the trolley to load rebar and concrete into the pier cap form or pre-cast shell established on top of the new lead pier structure.

FIG. 15 illustrates the use of the first main trolley 62A to lower rebar and/or cement into the cap form or pre-cast shell created by the first and second pier cap forms or pre-cast shells 122A, 122B, thereby establishing the cap 94 of the now completed, new lead pier structure 120. At this point, the lead portion of the lead assembly 58 can be rotated to a substantially horizontal position so that the hammer can be reattached to the assembly 58. Further, upon repositioning the first main trolley 62A and the first auxiliary trolley 64A, the apparatus 50 is in substantially the same orientation as shown in FIG. 2. Consequently, the process can be repeated to establish girders between the new lead pier structure 120 and the now old, lead pier structure 82 and to establish a newer lead pier structure beyond the new lead pier structure 120. It should be appreciated that the sequence of steps followed in constructing the bridge can be varied. For example, after the truss structure 52 is positioned as shown in FIG. 4, the piles could be driven for the new lead pier structure 120 before the girders are erected between the lead pier structure 86 and the penultimate pier structure 90. As another example of a variation in the sequence of steps followed in constructing the bridge, the operations of driving a pile for the new lead pier structure 120 and the erection of a girder between the lead pier structure 86 and the penultimate pier structure 90 can be alternated with one another. Typically, there are several different operations that can be performed at any given point in time using the apparatus 50 with the timing of the delivery of elements needed to construct the bridge typically being determinative of the operation that the apparatus is used to perform at any particular point in time.

Figure 16A:
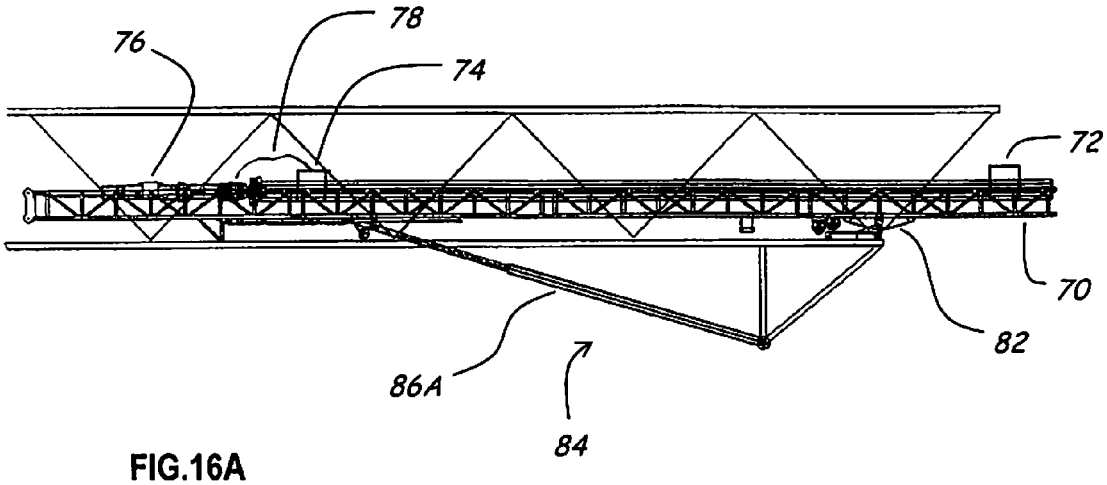
FIG. 16A-C illustrates an embodiment of a lead assembly that comprises a lead, a hydraulic system that is used to rotate the lead, a hammer that is attached to the lead, and a winch for adjusting the position of the hammer on the lead.
Figure 16C:
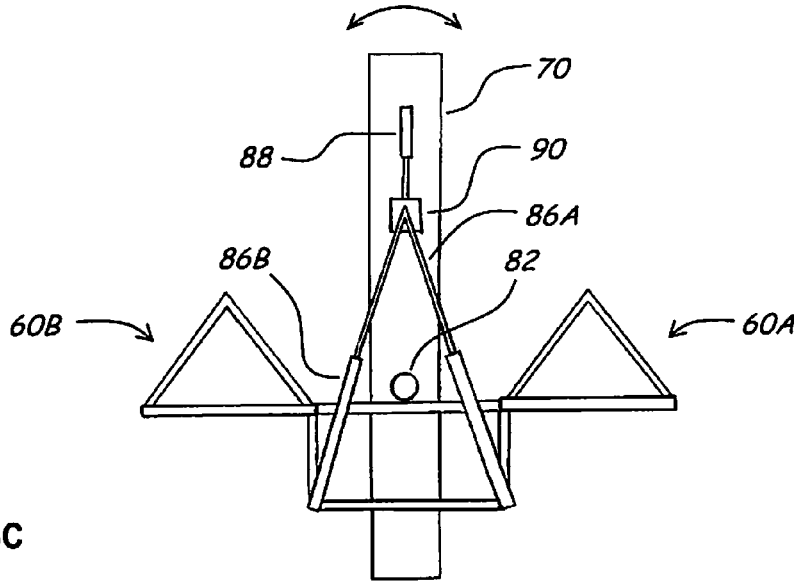
Figure 16B:
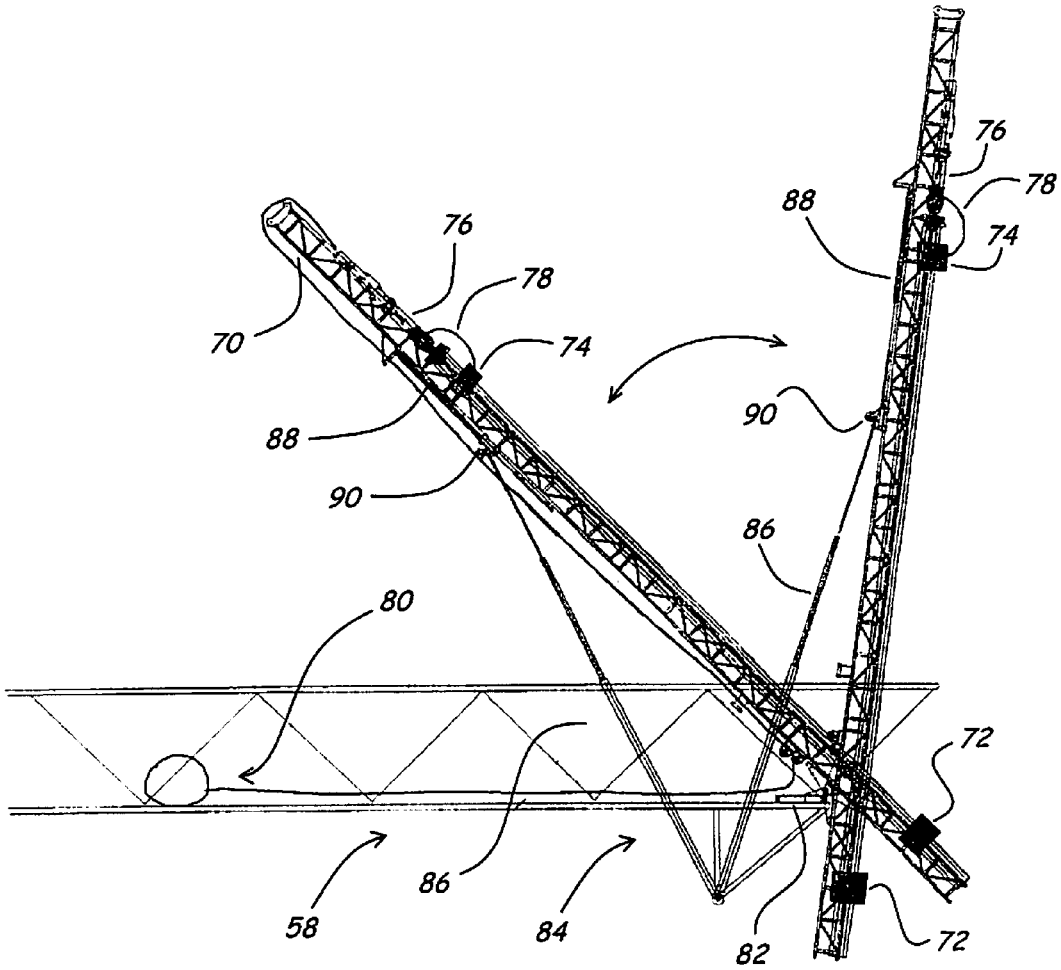

With reference to FIGS. 16A-C, the lead assembly 58 is described in greater detail. The assembly 58 is comprised of a truss or lead 70, a guide 72 for receiving a pile, a collar clamp 74 for guiding and gripping a pile, a hammer 76 for repeated striking of one end of a pile to drive the pile into the earth, a cord 78 for connecting the collar 74 to the hammer 76, a cable/pulley/winch system 80 for controlling the position of the hammer 76 relative to the lead 70, a two-axis pivot joint 82 that connects the lead 70 to the truss 52, and a hydraulic system 84 for rotating the lead 70 about the pivot joint 82. The two axes of the pivot joint 82 are typically perpendicular to one another. The guide 72 and the collar clamp 74 preferably are each of a clam-shell type of design that allows two halves to be separated so as to receive a pile from the trolley structure 54.

In operation, the assembly 58 is initially in a substantially horizontal position, as shown in FIG. 16A. To receive a pile, the guide 72 and the collar 74 are placed in an open position. After a pile has been received, the guide 72 and collar 74 are placed in a closed position. When the guide 72 and the collar 74 are in the closed position, the pile is substantially fixed in a position relative to the lead 70. In this regard, the collar 74 holds the pile, and the cord 78 that is connected to the hammer 76 prevents the pile from moving longitudinally, i.e. in the direction of the longitudinal axis of the lead 70, absent movement allowed by the cable/pulley/winch system 80. The guide 72 and the collar 74 also prevent the pile from rolling off of the lead 70.

After the pile has been fixed in position relative to the lead 70, the hydraulic system 84 is used to rotate the pile about the two-axis pivot joint 82 to a desired orientation. In this regard, the hydraulic system 84 is comprised of a first and second hydraulic actuators 86A, 86B and a third hydraulic actuator 88 that both engage a shuttle 90 that is engaged to the lead 70 and whose position along the lead depends on length of the first and second hydraulic actuators 86A, 86B and the third hydraulic actuator 88. By appropriate manipulation of the first and second hydraulic actuators 86A, 86B and the third hydraulic actuator 88, the lead 70 and any associated pile can be positioned at a desired angle within a vertical plane that is substantially parallel to the longitudinal axis of the truss structure 52 or, stated differently, at a desired rotational position relative to the first axis of rotation provided by the two-axis pivot joint 82. The first and second hydraulic actuators 86A, 86B also allow the rotational position of the lead 70 and any associated pile within a plane that is transverse to the longitudinal axis of the truss structure 52 (or, stated differently, within a plane that is substantially parallel to or passes through the first axis of rotation provided by the two-axis pivot joint 82) to be adjusted. This is accomplished by adjusting the lengths of the first and second hydraulic actuators. To elaborate, when the lengths are equal, the lead 70 is positioned as shown in FIG. 16C. However, when the lengths are unequal, the lead 70 is rotated clockwise or counter-clockwise relative to the position of the lead 70 in FIG. 16C. During rotation of the pile, the cable/pulley/winch system 80 prevents movement of the hammer 76; the cable 78 that is attached to the hammer 76, in turn, prevents movement of the collar 74; and the collar 74, in turn, prevents, movement of the pile relative to the collar. Consequently, the position of the pile is maintained during rotation of the pile by the assembly 58. It should be appreciated that rotation of the lead 70 can be accomplished using any number of other mechanical devices and combinations of mechanical devices known in the art or readily conceived by those skilled in the art. For example, a winch, cable, and pulley system or a system that includes one or more motorized screws could be used to adjust the rotational position of the lead.

After the desired rotational position of pile has been achieved, the cable/pulley/winch system 80 is used to lower the hammer 76 and the pile until the distal end of the pile engages the earth into which the pile is to be driven. At this point, the cable 78 becomes slack and the hammer 76 is used to drive the pile into the earth.

Figure 17:
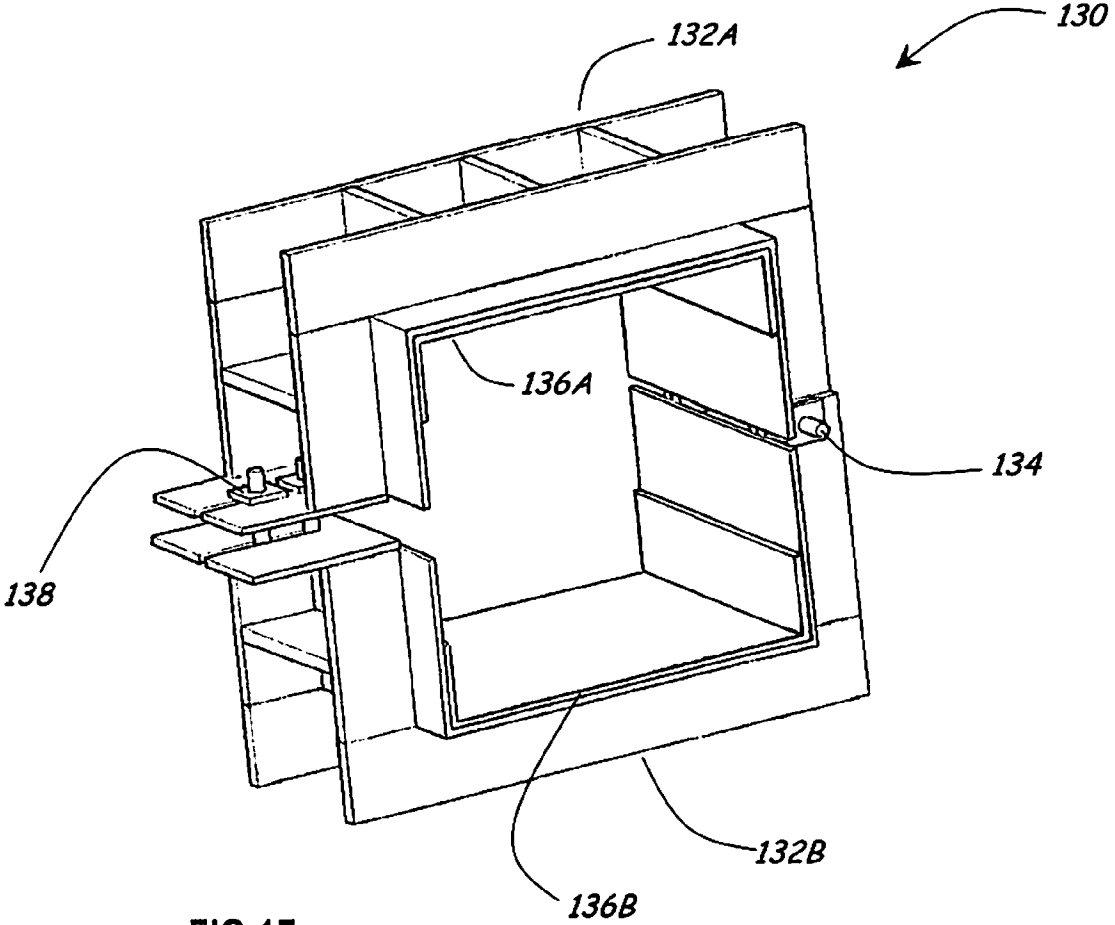
FIG. 17 illustrates an embodiment of a pile collar clamp for holding a pile in a fixed position relative to the pile driver lead and hammer assembly during rotation of the pile driver lead and hammer assembly.

FIG. 17 illustrates an embodiment of the collar 74, hereinafter referred to as clamp pile collar clamp 130, that is suitable for engaging a pile with a square cross-section. It should be appreciated that clamps are feasible for piles with different cross-sections, such as a circular cross-section. The clamp 130 is comprised of a first and second C-shaped members 132A, 132B, which are pivotably connected to one another by a hinge pin 134. Respectively located on the interior surfaces of the first and second members 132A, 132B are first and second friction surfaces 136A, 136B that, in operation, engage a pile to prevent the pile from slipping relative to the clamp 130. A tensioner/lock assembly 138 allows the clamp 130 to be placed in an open condition in which at least one of the members 132A, 132B rotates about the axis defined by the hinge pin 134 so that a pile can be placed within the clamp 130. After a pile has been placed in the clamp 130, at least one of the members 132A, 132B is rotated about the axis defined by the hinge pin 134 so as to place the clamp in a closed position, substantially as shown in FIG. 17. The tensioner/lock 138 is then used to fix the position of the first and second members 132A, 132B to one another and pull the first and second members 132A, 132B towards one another to apply a sufficient gripping force to the pile.

In many situations, a pile can be guided using only the guide 72. Consequently, the collar 74 is not mounted to the lead 70. If, however, it is desirable that the collar 74 also assist in guiding a pile, the collar 74 can be slidably mounted to the lead 70. In the illustrated embodiment, the clamp 74 can be slidably mounted to in a number of ways known or conceivable to those skilled in the art. For example, the clamp 74 can incorporate C-shaped brackets that engage the two rails that define the open side of the lead 74 that receives a pile or other object. In the case of the clamp 130, two such C-shaped brackets can be mounted to the appropriate one of members 132A, 132B to achieve a slidable mount.

Figure 18A:
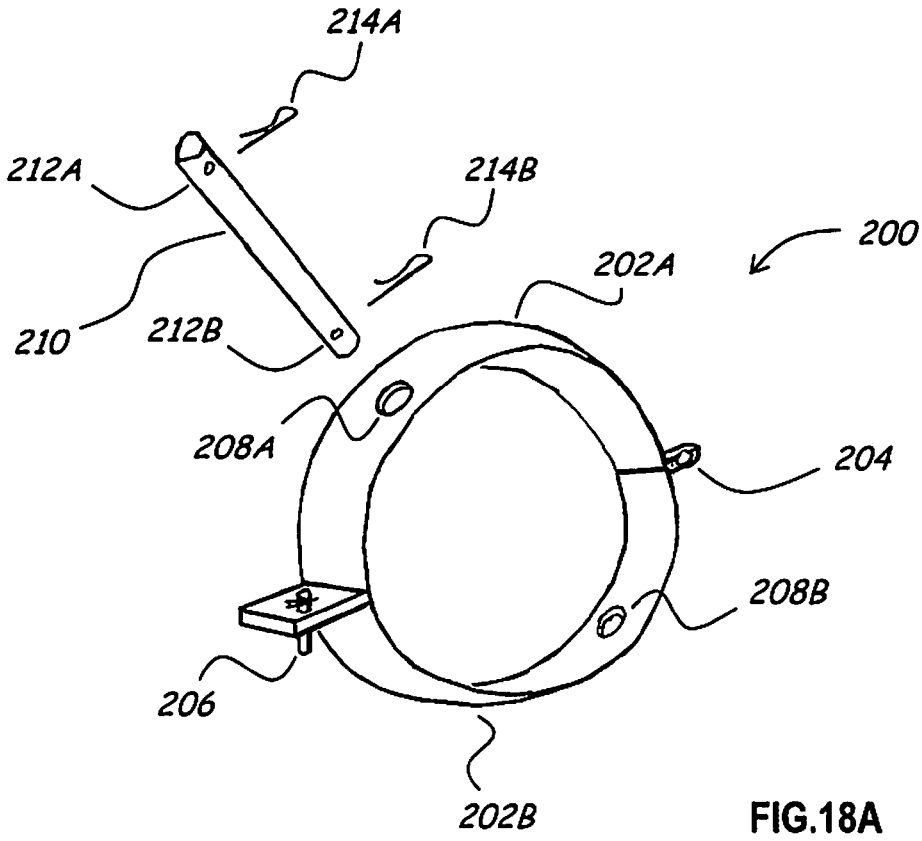
FIGS. 18A and 18B illustrate alternative devices for holding a pile or similar structure in place on a lead.

Other clamps or devices for holding a pile or similar structure are feasible. For example, FIG. 18A illustrates a holder 200 that is suitable for receiving a pile or similar structure with a circular cross-section and through which a transverse hole has been established. The holder 200 comprises first and second members 202A, 202B that are connected to one another by a hinge joint 204. A connector 206 is used to fix the first and second members 202A, 202B to one another after a pile has been received. The first and second members 202A, 202B respectively have pin holes 208A, 208B for receiving a pin 210 that also passes through the hole in the pile, column, or other bridge element. The pin 210 has first and second cotter pin holes 212A, 212B that respectively receive cotter pins 214A, 214B, to fix the pin 210 in place relative to the first and second members 202A, 202B.

Figure 18B:
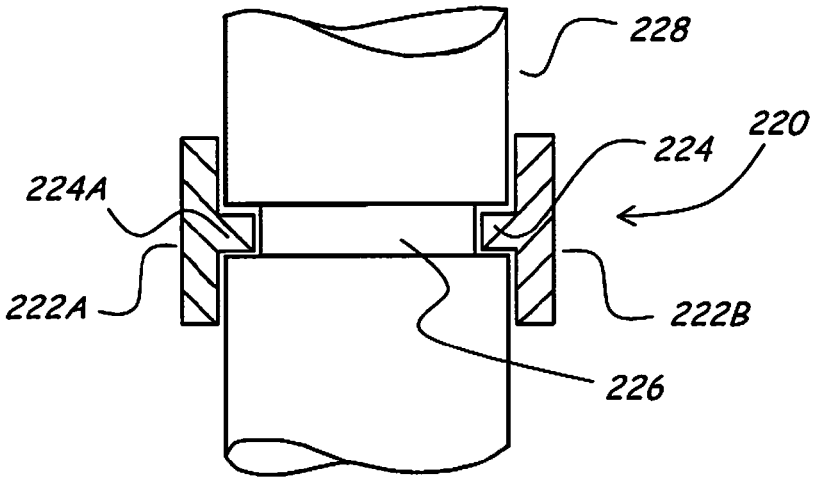

FIG. 18B illustrates another clamp that can hold a pile or similar object. In this case, clamp 220 has first and second members 220A, 220B that are connected to one another by a hinge joint and fixed together by a connector, just as with the clamp 130 and holder 200. The first and second members 220A, 220B respectively have male members 224A, 224B that engage a groove 226 in a pile 228 or similar structure.

The lead assembly 58 can be used to receive columns and other similar structures that do not require the use of a hammer to be put in place, rotate the column or similar structure, and lower the column or similar structure into place. With respect to the placement of such structures, the lead assembly 58 does not need to incorporate a hammer.

Figure 19:
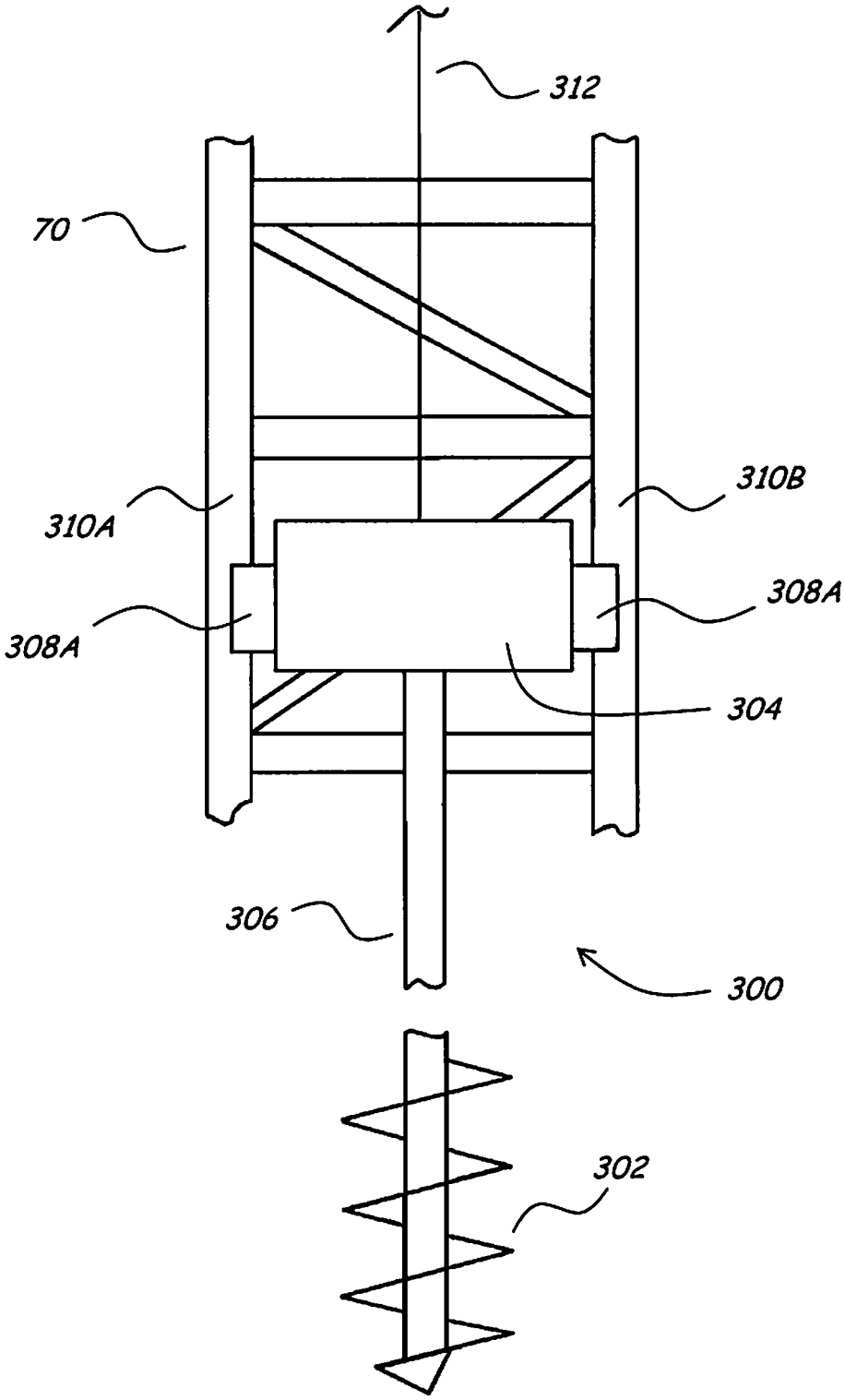
FIG. 19 illustrates a portion of a lead assembly that includes a drill for excavating a hole for a pile, concrete drilled shaft, or similar structure.

The lead assembly 58 can also incorporate tools other than a hammer. With reference to FIG. 19, the lead assembly 58 comprises a drill 300. The drill 300 is comprised of a bit 302, a motor 304, a kelly bar 306 for connecting the motor 304 to the bit 302, and mounts 308A, 308B for slidably mounting the motor 304 to the two rails 310A, 310B that define the open side of the lead 70. The cable, pulley, and winch system 80 is used to control the position of the drill 300 relative to the lead during the drilling operation. In this regard, the cable 312 is attached to the motor 304. In an alternative embodiment, a pass-through motor is mounted to the lead 70 with a fixed or semi-fixed bracket that allows the motor to move up and down the lead for a limited distance. The Kelly bar and drill bit are suspended using the winch and cable. The motor is designed to allow the kelly bar to pass through an opening that is designed to transfer torque from the motor to the Kelly bar and the drill bit.

Figure 20:
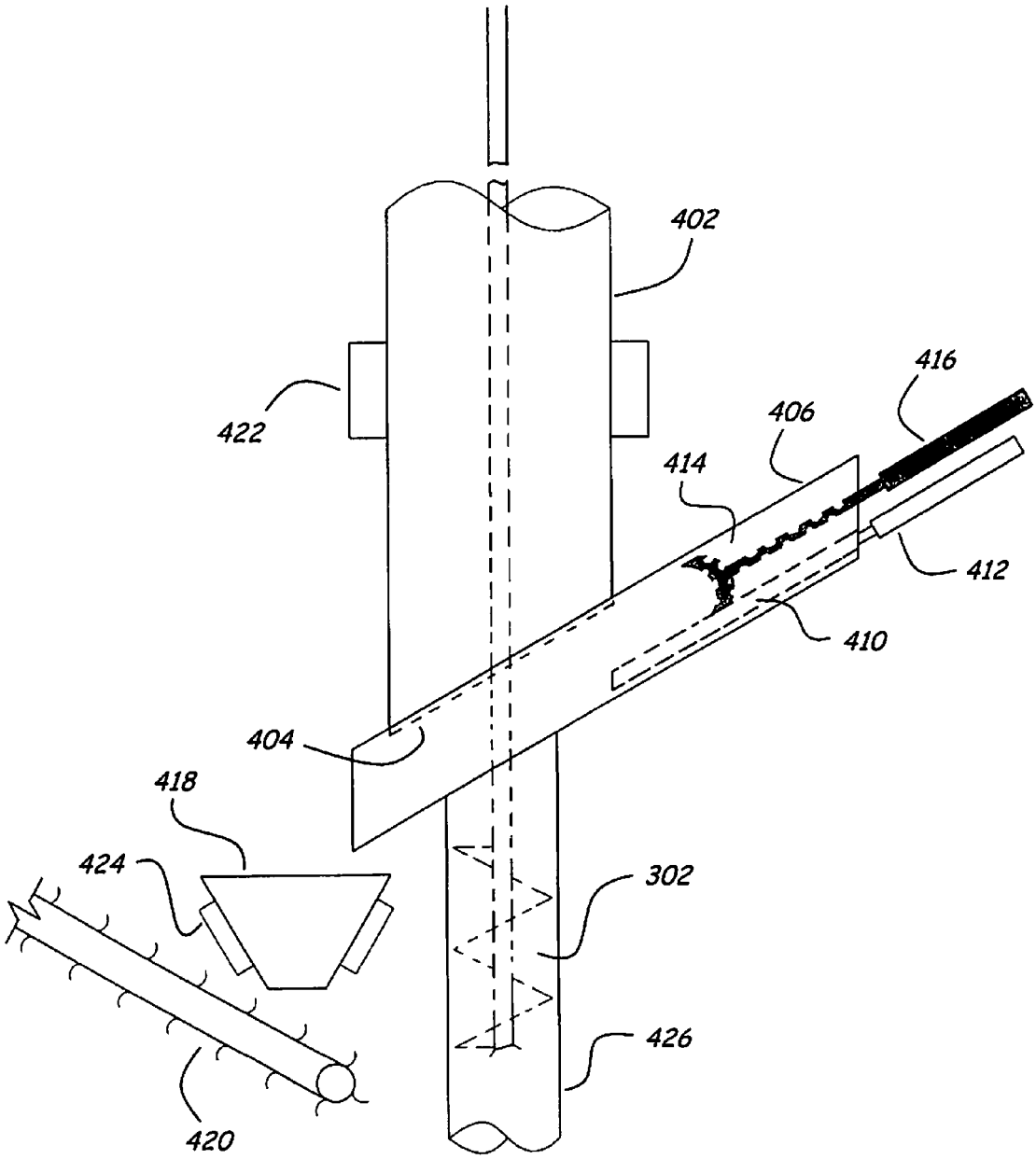
FIG. 20 illustrates a system for the removal of drill tailings produced by the operation of the drill illustrated in FIG. 19.
Figure 21:
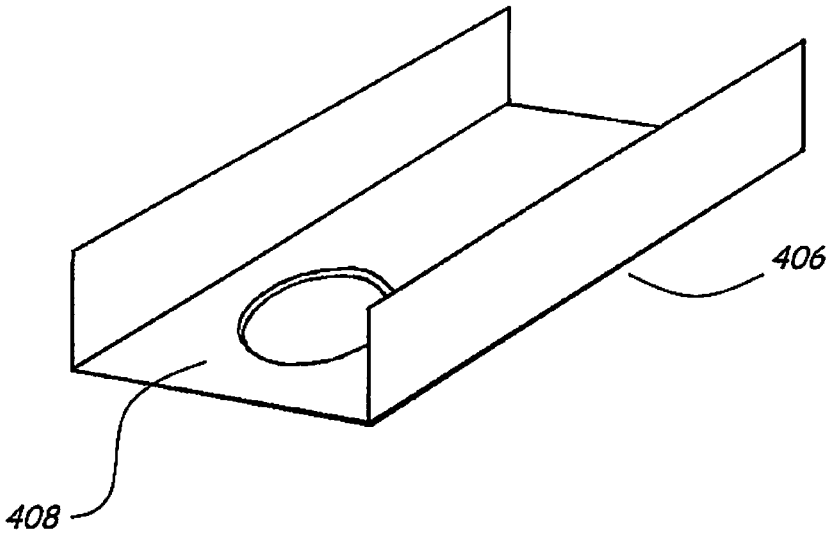
FIG. 21 is a perspective view of the guide box of the system illustrated in FIG. 20.

FIG. 20 illustrates a tailings removal system 400 for removing the drill tailing produced during operation of the drill 300 or other excavation tool that might be associated with the lead assembly 58. The tailings removal system 400 is attached to the underside of the truss structure 52 and positioned so as to receive the drill bit 302 of the drill 300 that is attached to the lead 70. The system 400 comprises an upper casing 402 that has a lower opening 404 and through which the drill bit 302 passes, a guide box 406 with a hole 408 (FIG. 21) through which the drill bit 302 can pass, a cover plate 410, a hydraulic actuator 412 for moving the cover plate 410 so as to cover and uncover the hole 408, a rake 414 for use in pushing drill tailings off of the cover plate 410 when the cover plate 410 is covering the hole 408, a hydraulic actuator 416 for moving the rake 412, a hopper 418 for receiving tailings that either slide of the cover plate 410 when the cover plate 410 is covering the hole 408 or are pushed off of the cover plate 410 by the operation of the rake 414 and hydraulic actuator 416 when the cover plate 410 is covering the hole 408, a conveyor 420 for receiving tailings from the 418 and conveying the tailings to a desired location. Associated with the upper casing 402 is a vibrator 422 that, if needed, can be used to shake tailings free from the drill bit 302 when the drill bit 302 has been retracted into the upper casing 402. Similarly, associated with the hopper 418 is a vibrator 424 that, if needed, can be used to shake tailings free from the hopper 424. The vibrators 422, 424, are typically needed when the tailings are comprised of material that has a high clay content or is very viscous. Depending on the material being excavated, the vibrators 422, 424 may or may not be needed. It should also be appreciate that the cover plate 410 and rake 414 can each be actuated by other types of actuators. For example, a motorized screw or rack-and-pinion type of actuator can be used, as well as other types of actuators known in the art.

Prior to the use of the drill 300 to excavate a hole and the use of the system 400 is remove the tailings produced by the excavation, a lower casing 428 is driven into the ground. Typically, the lower casing 428 is driven into the ground using the lead assembly 58 with an associated hammer. The lower casing 428 serves both to guide the drill bit 302 and, once a sufficient amount of material has been excavated by the drill bit 302, contain the tailings as the drill bit 302 is retracted.

After the lower casing 426 is in place, excavation of a hole with the drill 300 and removal of the tailings with the system 400 commences with, if necessary, putting the drill 300 into place on the lead 70 and putting the system 400 in place on the truss structure 52. Typically, the trolley structure 54 is used to put the drill 300 into place on the lead 70. Putting the drill 300 into place on the lead 70 may involve using the trolley structure 54 to remove a tool that is already attached to the lead 70, such as a hammer, and then use the trolley structure 54 to place the drill 300 in place. The trolley structure 54 is also used to position the elements of the system 400 for attachment to the truss structure 52.

With the drill 300 in place on the lead 70 and the system 400 operatively attached to the truss structure 52 with the cover plate 410 and the rake 412 each retracted as shown in FIG. 20, the excavation of a hole using the drill 300 and the excavation of the tailings therefrom commences with the rotation of the lead 70 so that the drill bit 302 is aligned from insertion through the upper casing 402 and the lower casing 426. Once aligned, the cable, pulley, winch system 80 is used to lower the drill until the drill bit 302 engages the ground. Typically, the drill 300 is activated to begin rotating the drill bit 302 before the bit engages the ground. Excavation commences when the drill bit 302 has engaged the ground and the drill 300 has been activated. The weight of the motor 304 and other elements of the drill 300 that are located above the drill bit 302 is used to force the bit into the ground. In many case, this weight is too great for the type of drill bit being used and/or for the earth that is being excavated. In such cases, the cable, pulley, winch system 80 is used to moderate the force being applied to the drive the drill bit 302 into the ground.

Once the drill bit 302 has progressed a certain distance into the ground, the cable, pulley, winch system 80 is used to retract the drill bit 302 into the upper casing 402. After the tip of the drill bit 302 moves past the top of the lower casing 426, the hydraulic actuator 412 is used to position the cover plate 410 over the hole 408 of the guide box 406. At this point, excavated material may fall of the drill bit 302 and onto the cover plate 410 and guide box 406. After the tip of the drill bit 302 moves past the lower opening 404 of the upper casing 402, the hydraulic actuator 416 can be used, if needed, to push any excavated material that has fallen off of the drill bit 302 into the hopper 418.

Excavated material may naturally fall off of the drill bit 302 and onto the cover plate 410 and guide box 406. Further, this material may slide down the cover plate 410 and the guide box 406 and into the hopper 418 without any assistance. If, however, the material either does not slide down the cover plate 410 and the guide box 406 or does so too slowly, the rake 414 and hydraulic actuator 416 can be employed to force the material into the hopper 418. In many cases, the excavated material does not naturally fall off the drill bit 302. In such cases, the vibrator 422 is used to shake the material off of the drill bit so that the material falls onto the cover plate 410 and the guide box 406. The material can then, if needed, be pushed into the hopper 418 using the rake 414 and hydraulic actuator 416. It should be appreciated that regardless of the consistency of the excavated material, the rake 414 may be actuated at a desired frequency. Moreover, the actuation of the rake 414 may be coordinated with the operation of the vibrator 422. For example, the vibrator 422 could activated to cause material to fall onto the cover plate 410 and guide box 406 while the rake 414 is retracted, and then the vibrator 422 can be deactivated and the rake 414 actuated to push the material that previously fell onto the cover plate 410 and guide box 406 into the hopper 418. This cycle can be repeated as needed.

Excavated material that is in the hopper 418 is dispensed onto the conveyor 420, which transports the material to a desired location for disposal. The material may naturally flow out of the hopper 418 and onto the conveyor 420. If, however, the material is of a consistency that such a natural flow does not occur, the vibrator 424 can be utilized to force the material out of the hopper 418 and onto the conveyor 420.

Figure 22:
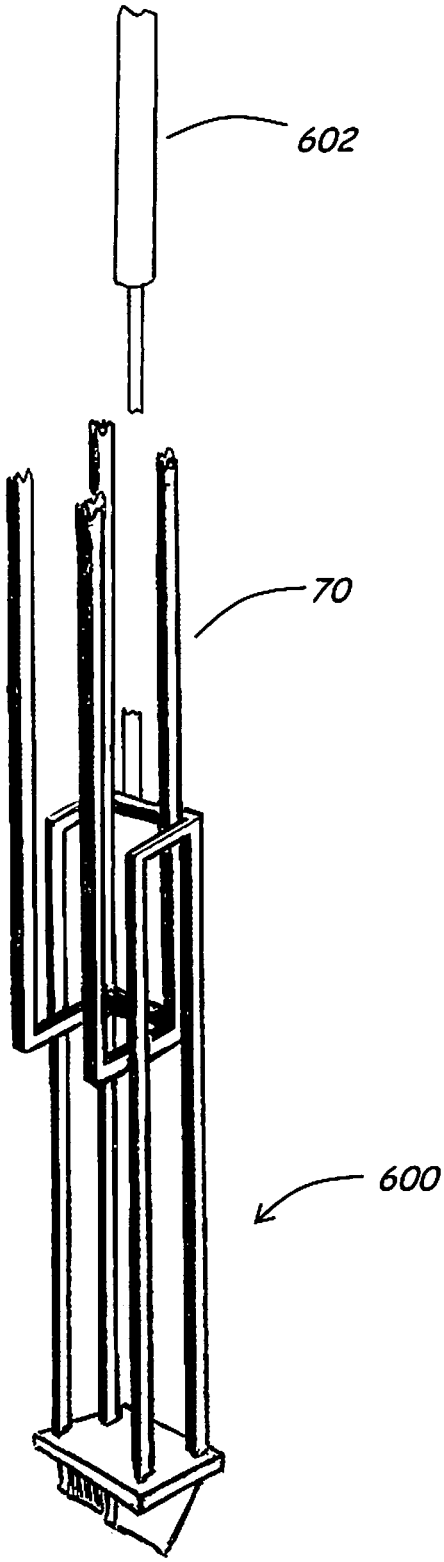
FIG. 22 illustrates a lead with a ground engaging structure that can be extended to contact the ground so as to reduce the force being applied to the end of the truss structure when a heavy object, such as a pile, is being positioned to be driven into the ground.

FIG. 22 illustrates a ground engagement structure 600 that is attached to the lead 70 and can be extended from the bottom of the lead 70 to engage the ground. The ground engagement structure 600 engages the lead 70 in a manner comparable to an extension ladder. When engaging the ground, the structure 600 and the lead 70 operate to apply a force to the truss structure 52 that counteracts the force that is applied to the truss structure when the lead assembly is being used to drive a pile or other significant force is being applied adjacent to the terminal end 61B of the truss structure. The ground engagement structure 600 is extended and retracted using a hydraulic actuator 602. However, it should be appreciated that other types of actuators can be employed.

Figure 23:
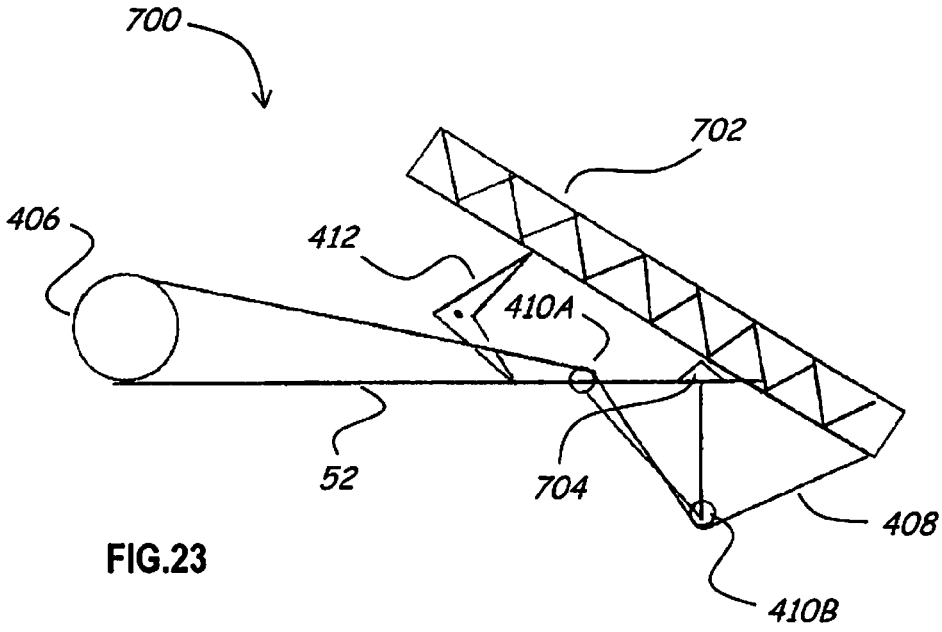
FIG. 23 illustrates an alternative embodiment lead assembly that utilizes a cable, pulley, and winch system to rotate a lead.

FIG. 23 schematically illustrates a second embodiment of a lead assembly 700 that comprises a lead 702, a two-axis pivot joint 704 for connecting the lead 702 to the truss structure 52, a winch 406, a cable 408 that extends from the winch 406 to the lead 702, and a pair of pulleys 410A, 410B that guide the cable 408, a hinged resistive element 412 that moderates the rotation of the lead 702 caused by the winch 406. The hinged resistive element 412 provides resistance by utilizing a hydraulic element. It should be appreciated that the other resistive elements are feasible, including elements that are not hinged. In operation, the winch 406 and cable 408 are used to move the lead 702 to a desired rotational position about an axis that is transverse to the longitudinal axis of the truss structure. The hinged resistive element 412 moderates the rotational operation.

Figure 24:
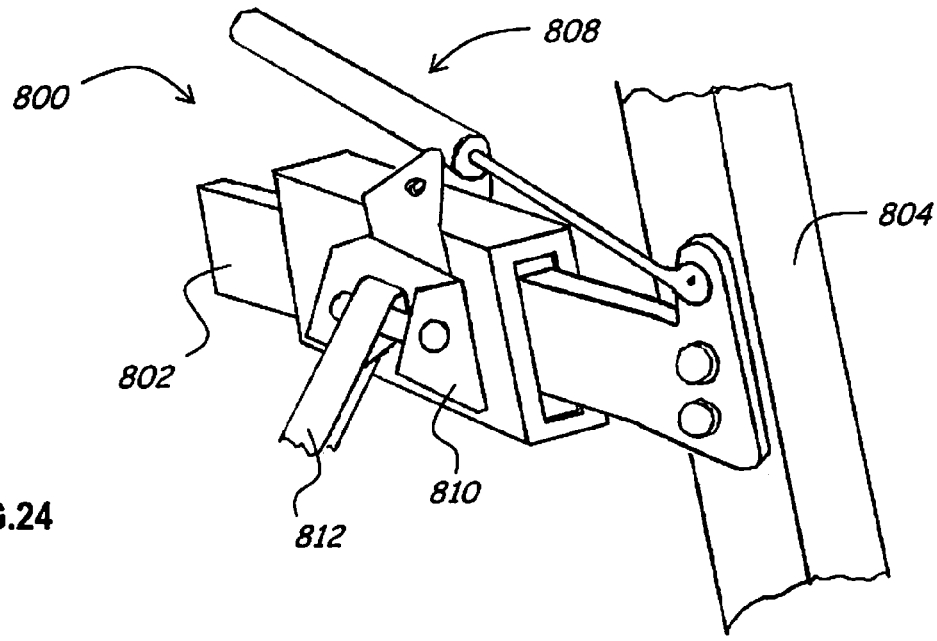
FIG. 24 illustrates an alternative embodiment of a device that is suitable for rotating a lead in a plane that is transverse to the longitudinal axis of the truss structure.

FIG. 24 illustrates a second embodiment of a device 800 for use in causing the lead to rotate in a plane that is transverse to the longitudinal axis of the truss structure 52. The device 800 comprises a curved plate 802 that is fixed to a lead 804, a slotted box 806 that receives the plate 802, a hydraulic actuator 808 with a cylinder that is pivotally attached to the slotted box 806 and a rod that is pivotally and operatively attached to the lead 804, and a pivot attachment 810 for a support 812 that is attached to the truss structure 52 and not readily susceptible to rotation about the longitudinal axis of the truss structure 52. In operation, the hydraulic actuator 808 is used to apply a force to the lead 804 that causes the lead to move relative to the slotted box 810 and, more specifically, to rotate in a plane that is transverse to the longitudinal axis of the truss structure 52.

Figure 25:
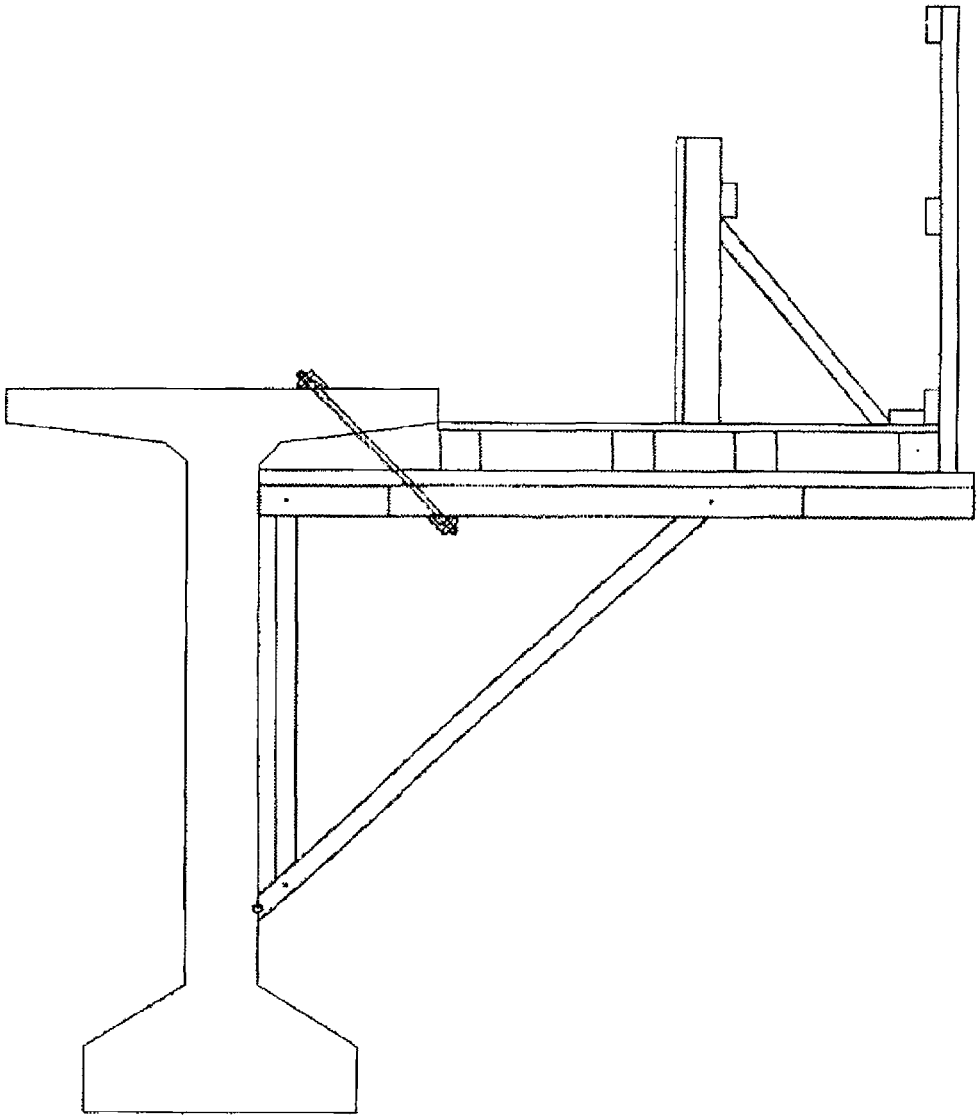
(PRIOR ART) FIG.25
FIG. 25 illustrates a prior-art edge form that is used to establish an L-shaped concrete member along the lateral edge of a bridge superstructure.

FIG. 25 illustrates a girder 140 that is the outer-most lateral girder of a bridge superstructure and the form 142 that must be attached to the girder 140 to create an L-shaped edge that is attached to the girder 140. The L-shaped edge serves to contain concrete or other fluid material that is poured on top of the girder to establish the superstructure deck. In addition, the L-shaped edge provides a surface for attaching a lateral barrier, such as a fence.

Figure 26:
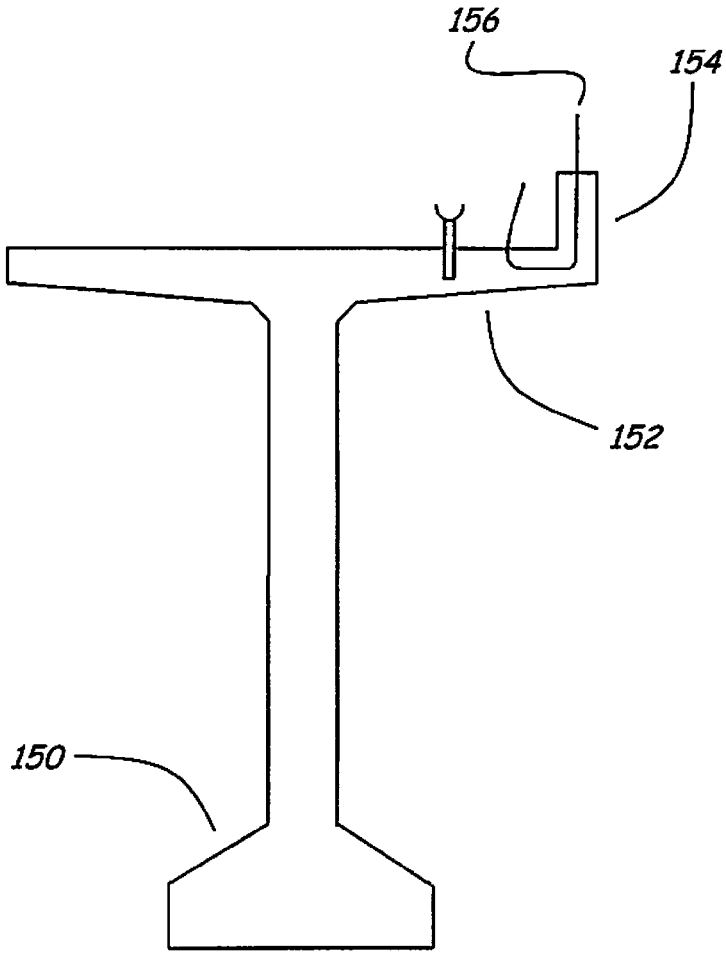
FIG. 26 illustrate a pre-cast edge girder that avoids the need to use the prior art edge form shown in FIG. 18.

FIG. 26 illustrates a girder 150 that is used in a bridge superstructure as the outer-most girder. The girder 150 is pre-cast so as to have a laterally extending portion 152 and a vertically extending portion 154 that is operatively connected to the laterally extending portion so as to form an L-shaped edge that is useful for containing concrete or other fluid material that is poured on top of the girder to establish the superstructure deck. If desired rebar 156 can be incorporated into the vertically extending portion 154 of the girder. It should be appreciated that the edge can be other shapes that serve the various purposes for which an edge is used on a bridge superstructure.

The embodiments of the invention described above are intended to describe the best mode known of practicing the invention and to enable others skilled in the art to utilize the invention.

What is claimed is:

1. A method for establishing an L-shaped lateral edge of a bridge superstructure that substantially avoids the need for an L-shaped form to establish such an edge comprising:

providing a first pier that extends above a surface that is to be spanned;

providing a second pier that extends above the surface that is to be spanned and is spaced from the first pier;

providing a first precast edge girder having a first flange that extends between a first pair of terminal ends, a second flange that is separated from the first flange and that extends between a second pair of terminal ends, a web extending between first and second web terminal ends and connecting the first flange and the second flange, wherein the first web terminal end is operatively connected to the first flange such that the first web terminal end is spaced from each of the first pair of terminal ends of the first flange, wherein the second web terminal end is operatively connect to the second flange such that the second web terminal end is spaced from each of the second pair of terminal ends of the second flange, wherein the first flange, second flange, and web generally have an I-beam cross-section, the first precast edge girder further having an edge portion that is connected to the second flange and extends away from the first and second flanges;

first positioning the first precast edge girder so that portions of the first flange are located between portions of the second flange and the first and second piers.

2. A method, as claimed in claim 1, wherein said first positioning comprising:

positioning the first precast edge girder so that the edge portion substantially defines a first lateral boundary for a portion of a deck of the bridge.

3. A method, as claimed in claim 1, further comprising:

providing a second precast edge girder;

second positioning the second precast edge girder so that portions of the first flange of the second precast edge grider are located between portions of the second flange of the second precast edge girder and the first and second piers.

4. A method, as claimed in claim 3, wherein said first positioning comprising:

positioning the first precast edge girder so that the edge portion substantially defines a first lateral boundary for a portion of a deck for the bridge.

5. A method, as claimed in claim 3, wherein said second positioning comprising:

positioning the second precast edge girder so that the edge portion of the second precast edge girder defines a second lateral boundary for a portion of the deck of the bridge.

6. A method, as claimed in claim 3, wherein:

said first positioning comprising positioning the first precast edge girder so that the edge portion substantially defines a first lateral boundary for a portion of a deck for the bridge;

said second positioning comprising positioning the second precast edge girder so that the edge portion of the second precast edge girder defines a second lateral boundary for the portion of the deck of the bridge; and the first lateral boundary is separated from and substantially parallel to the second lateral boundary.

7. A method, as claimed in claim 3, further comprising:

providing a girder that does not have an edge portion;

third positioning the girder to operatively engage the first and second piers and be located between the locations of the first and second precast edge girders relative to the first and second piers.

8. A precast girder suitable for use in establishing an L-shaped lateral edge of a bridge superstructure and substantially avoiding the need for an L-shaped form to establish such an edge comprising:

a first flange that extends between a first pair of terminal ends;

a second flange that is separated from. the first flange and that extends between a second pair of terminal ends;

a web extending first and second web terminal ends and connecting the first flange and the second flange, wherein the first flange, second flange, and web generally have an I-beam cross-section, wherein the first web terminal end is operatively connected to the first flange such that the first web terminal end is spaced from each of the first pair of terminal ends of the first flange, wherein the second web terminal end is operatively connect to the second flange such that the second web terminal end is spaced from each of the second pair of terminal ends of the second flange; and an edge portion that is connected to the second flange and extends away from the first and second flanges.

9. A precast girder, as claimed in claim 8, wherein:

the second flange extends from a first terminal end to a second terminal end;

the web is connected to the second flange at a location that is between the first and second terminal ends; and the edge portion being located closer to the first terminal end than the second terminal end.

10. A precast girder, as claimed in claim 8, wherein:

the second flange and the edge portion have a generally L-shape.

11. A precast edge girder, as claimed in claim 8, further comprising:

a rebar that extends from a first rebar terminal end to a second rebar terminal end, wherein a portion of the rebar is embedded within one of the second flange and the edge portion and at least one of the first and second rebar terminal ends is located outside of the first flange, second flange, and web.

* * * * *

UNITED STATES PATENT AND TRADEMARK OFFICE

CERTIFICATE OF CORRECTION

PATENT NO. : 8,060,966 B2
APPLICATION NO. : 12/426517
DATED : November 22, 2011
INVENTOR(S) : Elie H. Homsi It is certified that error appears in the above-identified patent and that said Letters Patent is hereby corrected as shown below:

Col. 15, line 5, in claim 8, following "a web extending", insert --between--.

Signed and Sealed this
Thirty-first Day of July, 2012

David J. Kappos

David J. Kappos
*Director of the United States Patent and Trademark Office*